US006832851B1

(12) United States Patent
von Wilcken

(10) Patent No.: US 6,832,851 B1
(45) Date of Patent: Dec. 21, 2004

(54) CONTAINER CONCRETE MIXING PLANT

(75) Inventor: Alexander von Wilcken, Munich (DE)

(73) Assignee: Walter-Heilit Verkehrswegebau GmbH, Munich (DE)

( * ) Notice: Subject to any disclaimer, the term of this patent is extended or adjusted under 35 U.S.C. 154(b) by 0 days.

(21) Appl. No.: 09/889,731

(22) PCT Filed: Jan. 19, 2000

(86) PCT No.: PCT/EP00/00402

§ 371 (c)(1),
(2), (4) Date: Jul. 19, 2001

(87) PCT Pub. No.: WO00/43178

PCT Pub. Date: Jul. 27, 2000

(30) Foreign Application Priority Data

Jan. 19, 1999 (DE) ..... 199 01 904

(51) Int. Cl.[7] ..... B28C 9/00

(52) U.S. Cl. ..... 366/26; 366/33; 366/53; 366/606

(58) Field of Search ..... 366/33, 53, 26, 366/606; 414/919, 332, 21

(56) References Cited

U.S. PATENT DOCUMENTS 3,741,440 A * 6/1973 Sanders, Jr. ..... 366/33
3,998,436 A * 12/1976 Allen et al. ..... 414/21
5,171,121 A * 12/1992 Smith et al. ..... 366/33
5,667,298 A * 9/1997 Musil et al. ..... 366/33
5,785,421 A * 7/1998 Milek ..... 366/33
6,186,654 B1 * 2/2001 Gunteret et al. ..... 366/26

FOREIGN PATENT DOCUMENTS

| | | |
|---|---|---|
| EP | 0004695 | 10/1979 |
| EP | 0236991 | 9/1987 |
| FR | 2756813 | 6/1998 |
| GB | 2133303 | 7/1984 |
| SE | 0440879 | 8/1985 |

* cited by examiner

*Primary Examiner*—Tony G. Soohoo
(74) *Attorney, Agent, or Firm*—Sidley Austin Brown & Wood, LLP

(57) ABSTRACT

The invention relates to a transportable concrete mixing plant (10) which comprises a plurality or releasably interconnected mixing plant components. Said mixing plant components are contained in a plurality of containers (C1, C2, C3, C4, C5, C6, C7, C8, C9, C10, C11, C12, C13), during transport. At least part of said containers (C1, C2, C3, C4, C5, C6, C7, C8, C9, C10, C11, C12, C13), preferably all of said containers, are standard ship containers or can be assembled to standard ship containers. Said standard ship containers meet the international standards for uniform transport. In the operational state of the mixing plant (10), said containers represent the support structure for mixing plant components and/or containers for concrete starting materials.

58 Claims, 17 Drawing Sheets

CONTAINER CONCRETE MIXING PLANT

The present invention relates to a transportable concrete mixing plant, in which all the components can preferably be transported in standard shipping containers.

Transportable concrete mixing plant is used by civil construction companies on building sites whose concrete requirement cannot be covered practically by the inward transport of concrete mixed at another site (for example in stationary transportable concrete mixing plant), for example using the known concrete mixing vehicles. This case may arise on large building sites, for example within the context of traffic projects, in which the concrete requirement is extremely high. However, the inward transport of concrete by means of concrete mixing vehicles may not be practical either in the case of very isolated building sites, so that in this case, too, a concrete mixing plant is needed on site.

For this reason, numerous civil construction companies have transportable concrete mixing plant, which is erected on a building site to produce concrete on site. For this purpose, concrete mixing plant of this type is formed from a number of mixing plant components which can be connected detachably to one another, which are transported to the building site individually, for example using heavy goods vehicles, and are assembled there.

In this case, the problem often arises that the mixing plant components, such as concrete mixers, cement silos, conveyor belts and the like, have dimensions which are unusual, because of their function, for which reason their transport, for example on heavy goods vehicles, is made more difficult. It is often necessary to apply for special approvals, which entails additional costs and delivery-date problems. In the case of transport by marine freighter or goods train, such as is necessary in the case of construction companies which are active superregionally or even worldwide, these unusual dimensions, excessive widths and the like of the mixing plant components lead to considerable costs and delays during transport.

It is therefore the object of the invention to provide a transportable concrete mixing plant whose components can be transported more quickly and more cost-effectively without using means for this, such as packaging devices or covering materials, which are not required for the actual operation of the concrete mixing plant, and therefore would give rise to unnecessary costs and an increased requirement for space on the building site.

According to the invention, this object is achieved by a transportable concrete mixing plant comprising a number of mixing plant components which can be connected detachably to one another and which during transport are accommodated in a number of containers, at least some of these containers, preferably all of these containers, serving as a load-bearing structure for mixing plant components and/or containers for concrete raw materials when the mixing plant is operating.

The invention offers the advantage that the containers containing the mixing plant components can be offloaded quickly, worldwide, at offloading stations of harbours, railway stations and the like, using the cranes and the like which are available there for this purpose. In addition, the transport of containers, using marine freighters, goods trains, heavy goods vehicles and the like, does not present any difficulties, so that the relatively rapid and cost-effective transport of the mixing plant components is possible, even over great distances.

The invention also offers the advantage that the containers protect the mixing plant components during transport and, in addition, offer transport volumes for the equipment needed additionally during the use of the concrete mixing plant.

Furthermore, the use of containers as a load-bearing structure for mixing plant components or as containers for concrete raw materials, such as aggregates, binders, water, additional compounds and additives, when the mixing plant is operating, offers the advantage that no separate devices have to be carried at the same time for this purpose. In this case, the containers can be used both as an open load-bearing structure similar to a framework and as a closed load-bearing structure similar to a housing. This means a reduction in the outlay on transport and, in addition, always ensures the completeness of all the components needed for the operation of the concrete mixing plant.

In order to be able to configure the transport of the concrete mixing plant particularly simply, it is proposed that the containers be standard shipping containers or be capable of being combined into standard shipping containers which can be transported in a standard way in accordance with international regulations, especially by ship, rail and heavy goods vehicle. The transport of the concrete mixing plant can then be carried out with any marine container freighter, container goods train and so on, which permits particularly rapid and cost-effective transport.

In order to be able to utilize the load-bearing structure or container function of the containers in a simple way, provision is made for at least some containers to have openable hatches through which, when the mixing plant is operating, mixing plant components accommodated in various containers, at least to some extent, can work together. Following transport, the containers are set up first of all on the building site at predefined relative positions beside one another or above one another, then the hatches in the walls of the containers are opened and the mixing plant components contained in the respective containers are, if appropriate, drawn out through the opened hatches in such a way that they can work together when the plant is operating. This offers the advantage that it is generally not necessary to lift mixing plant components out of their respective container.

In order to implement a transportable concrete mixing plant according to the invention, it is proposed that it have at least one mixer container, which contains at least one concrete mixer for the mixing of aggregates, of preferably cement-containing binder, of water and of additional compounds and additives for producing concrete and, by means of the fitting of appropriate components, can be extended in such a way that the performance is increased to correspond to the requirements of the building site, for example expansion from one to up to four mixers with corresponding enlargement of the number of silos, metering systems, conveying devices and so on. In this case, the concrete mixers used can be, for example, double-shaft mixers, known per se, in order to achieve high concrete production speeds in civil engineering, these mixers being filled from above with aggregates and binder and having at the bottom a bottom emptying opening, which can be closed as desired, for the removal of concrete. The number of mixers per container is essentially restricted by their space requirement and the permissible total weight of the container.

In this case, provision is advantageously made for that wall of the mixer container which is located above each mixer when the plant is operating to have a hatch which can be opened above each mixer. Through this hatch, which is opened when the plant is operating, the aggregates and the binder and, if necessary, additives are fed to the concrete mixer.

In an advantageous further development of a transportable concrete mixing plant of this type, it is proposed that it comprise at least one stackable mixer container which, when the mixing plant is operating, is arranged on the mixer container and which contains loading means for the introduction of binder, preferably cement, and of aggregates and, if necessary, additives into each mixer through the openable hatches located in the upper wall of the mixer container and through hatches which can be opened and are located in the bottom wall of the stackable mixer container, opposite the hatches. In the simplest case, these loading means could comprise a pipe which opens from above into the concrete mixer through the opened hatches.

However, provision is advantageously made for the loading means for each mixer to comprise a pilot silo for aggregates and a compartment for binders and, if apropriate, for additives, which in each case can be of approximately funnel-like design.

For the precise metering of the binder and, if appropriate, of the additives, it is expedient for the compartment to contain a balance. When a previously determined desired quantity is reached, the compartment outputs its contents to the concrete mixer.

In an advantageous development of the invention, provision is made for a conveying means leading through an opened hatch in a wall of the stackable mixer container into the latter for the introduction of binder and, if appropriate, additive into the stackable mixer container. In this case, this conveying means is arranged in such a way that its end that is downstream in the conveying direction is located over the hopper, so that binder and/or the additive falls into the hopper at this end.

Since at least some parts of the conveying means generally run in the open air, the binder or the additive conveyed by it must be protected against rain, wind and so on. For this reason, provision is advantageously made for the conveying means leading into the stackable mixer container to be a feed screw. In a feed screw of this type, a screw drive rotates in a pipe, which protects the material from the abovementioned influences. If this protection is ensured by other measures, then it is possible for the conveying means, if appropriate, to be designed as a conveyor belt as well.

In a development of the invention, effective feeding of aggregates can be ensured by the fact that, when at least two mixers are used, an aggregate conveying means is provided having a running direction which can be changed over optionally in order co feed the aggregates to the loading means respectively assigned to a mixer. The aggregate conveying means is in this case arranged in such a way that each of its two ends is located over a loading means. If the aggregates are fed to the aggregate conveying means between its two ends, in each case one loading means can be supplied with aggregates by optionally changing over the running direction of the aggregate conveying means.

In an efficient development of such a concrete mixing plant according to the invention, provision is made that, when at least three mixers are used, the aggregate conveying means can be moved to and fro over the loading means for the aggregates, between a number of operating positions in which each end of the aggregate conveying means is assigned to a loading means for aggregates. Thus, for example, four mixers arranged essentially equidistantly in a row, or the loading means assigned to them, can be supplied with aggregates by the aggregate conveying means being moved to and fro between two operating positions, and both running directions of the conveying means being utilized in each operating position.

Since the aggregate conveying means runs protected, essentially inside the stackable mixer container, for reasons of simplicity provision is made for the aggregate conveying means to be a conveyor belt.

It is expedient if, in the transportable concrete mixing plant according to the invention, an inclined conveying means passing through at least one wall of the stackable mixer container, through an opened hatch, is provided for introducing the aggregates into the stackable mixer container. This inclined conveying means receives the aggregates essentially at the level of the standing surface of the transportable concrete mixing plant according to the invention, and conveys them, on the aggregate conveying means described above, into the stackable mixer container standing on the mixer container.

Since this aggregate conveying process requires a length of the inclined conveying means which, under certain circumstances, exceeds the length of a standard shipping container, in an advantageous development of the invention provision is made for the inclined conveying means to be a conveyor belt which, during transport, is accommodated in the folded-up state in an inclined conveyor-belt container. Folding up the inclined conveyor belt in this way may be achieved by means of a number of hinges in an inclined conveyor-belt frame bearing the inclined conveyor belt.

As explained above, mixers with bottom emptying are expediently used. In this case, provision is made for that wall of the mixer container which is at the bottom when the plant is operating to have, under each mixer, a hatch which can be opened to remove concrete from the mixer container. It is thus possible for concrete to be removed from the mixer through the opened hatch in the lower wall of the mixer container.

This configuration is particularly advantageous when the mixer container is erected on a standing surface of a mixer frame which is dimensioned such that concrete can be discharged through the openable hatches, in order to remove concrete from the mixer container, into a heavy goods vehicle or the like provided underneath the standing surface. If more than one mixer is used, for example in the case of the embodiment shown later of the concrete mixing plant according to the invention having four mixers, it is also possible for two heavy goods vehicles to be provided "back to back" under the standing surface of the mixer frame and to be loaded with concrete simultaneously or directly one after another.

Instead of using a mixer frame of this type, however, it is also possible when the plant is operating, for the mixer container to stand on an offloading container, in whose top wall hatches which can be opened are provided, opposite the openable hatches in the bottom wall of the mixer container. In this case, the concrete discharged from the mixer falls into the offloading container and must be transported onwards from there.

This onward transport can be ensured by there being provided in one end wall of the offloading container an openable hatch, through which there passes a concrete conveying device, which during transport is accommodated completely in the offloading container, for conveying the concrete, for example to a heavy goods vehicle or the like provided beside the offloading container. This concrete conveying device could be a conveyor belt which is folded up during transport, in a way similar to the inclined conveying means presented above, and which is extended for operation.

However, a simpler and more cost-effective configuration consists in the concrete conveying device comprising an upper concrete collecting belt which, when the plant is operating, is accommodated completely in the offloading container and a lower concrete conveyor belt which, when the plant is operating, passes through the openable hatch in the end wall of the offloading container. The concrete discharged from the mixer container therefore falls firstly onto the upper concrete collecting belt and, at the end of the latter, onto the lower concrete conveyor belt running below it, which conveys it out of the offloading container.

In a development of the concrete mixing plant according to the invention, provision is made for it to comprise at least one binder silo container as a storage means for bander or the like, as well as, if appropriate, a corresponding silo container for concrete additive. Just its use of a container as a binder silo means a great simplification in the transport of a transportable concrete mixing plan, since conventional binder silos, because of their size and of their form, which is generally characterized by a round cross section, present difficulties during offloading and transport.

Provision is expediently made in this case for each binder silo or additive silo container, respectively, to stand upright on its end face. This construction reduces the space requirement on the building site and facilitates the removal of binder from the binder silo container.

In the case of building sites with a large concrete demand, provision is made for at least two binder silo or additive silo containers to be erected beside one another or on one another. The possibility, which is generally not provided in the case of conventional binder silos but can be implemented without difficulty when binder silo containers are used, of stacking such storage means for binders on one another, oriented vertically, permits the provision of a large supply of binder with a low requirement for space on the building site. If two binder silo containers are erected on one another, a continuous binder silo can be formed by opening hatches in the end walls resting on each other.

In order to solve the problem, known from conventional binder silos, of a largely emptied silo tipping over, for example in the event of severe wind, in the concrete mixing plant according to the invention, provision is made for each binder silo or additive silo container erected upright to be fastened, by means of transverse struts, to the stackable mixer container and/or to the mixer container and/or to the offloading container or to the mixer frame for the purpose of stabilization. This type of fastening effects significantly greater stabilization of each binder silo container than the fastening to the ground which is generally used in conventional binder silos.

In order to provide a flat substrate for the upright silo containers, and for their further stabilization, provision is made for each silo container which is not standing on a further silo container, and the offloading container and/or the mixer frame to be fastened on a common baseplate. In the simplest case, this baseplate may comprise an arrangement of girders, for example I-girders made of steel.

In order to remove the binder or additive from the silo containers, provision is preferably made for each silo container which is not standing on a further silo container, when in its operating state, to contain in its lower region a hopper whose upper cross section essentially corresponds to the cross section of the silo container and which tapers downwards.

The walls of this hopper can also be formed by metal plates which run obliquely away from the side walls of the silo container and, when operating, run towards each other at the bottom, and in this arrangement are fastened rigidly in the silo container, or they can rest on walls of the silo container during transport and, when operating, can be folded out into the above-described working position.

For reasons of safety, provision may also be made for each silo container which is not standing on a further silo container to have, on its end face which is located at the bottom when it is operating, a concrete slab for stabilization. A concrete slab of this type is expediently fastened rigidly to the corresponding end face.

In order to remove the binder or additive, provision is preferably further made, in the operating state, for a binder or additive conveying means to be arranged underneath the hopper opening, and to pass through a side wall of the container through an opened hatch. During transport, this binder conveying means is expediently kept in the silo container and, on the building site, is drawn out through the opened hatch.

Provision is preferably also made here for the binder or additive conveying means to be a feed screw. In this way, the binder is also protected against the influence of weather in this region of the concrete mixing plant according to the invention.

For the further transport of the binder or additive, provision is made for the binder or additive conveying means to work together with a vertical conveying means which runs essentially vertically or obliquely upwards on an outer wall of the silo container in such a way that it can transfer binder or additive to the latter for onward conveyance, the vertically or obliquely running conveying means advantageously also being a feed screw.

In this case, provision is made for the vertically or obliquely running conveying means to work together with the binder or additive conveying means which runs partly in the stackable mixer container in such a way that it transfers binder or additive to the latter for onward conveyance. Such a transfer of binder from a feed screw to another feed screw can be ensured by the pipes surrounding the two feed screws having openings located close beside one another, between which there runs a slide designed as a pipe or a chute.

For the purpose of transporting the binder or the additive from the silo to the mixer, instead of the three individual conveying means, only one conveying means, advantageously a feed screw, can be used.

In order to make work easier on the concrete mixing plant according to the invention, provision can further be made for ladders, safety railings and the like on the outside of the binder silo container, which during transport are accommodated in a container, preferably this container.

In order to complete the equipment of the concrete mixing plant according to the invention, provision is made for a concrete finisher and/or a working platform or the like, during transport, to be accommodated in a container, preferably a silo container. In particular in the case of large concrete mixing plant according to the invention, in which empty binder silo containers are carried as well during transport, such devices can be transported at the same time without difficulty. This also reduces the transport costs for these machines, in particular in the case of marine transport, since these machines otherwise cannot be transported on container ships.

In a development of the transportable concrete mixing plant according to the invention, provision is made for it to comprise at least one metering-unit container which contains a metering device for metering the aggregates. The metering of the aggregates is carried out in this case in the metering-unit container and coordinated with the above-described metering of the binder or additive into the binder hopper. Monitoring and possible correction of the quantity of aggregates metered in this way can be carried out via an additional balance in the pilot silo for aggregates in the stackable mixer container.

Simple configuration of a metering device of this type is possible if the metering device for aggregates has at least one weighing conveyor belt for weighing and transporting the aggregates, and at least one loading means assigned to the weighing conveyor belt. Weighing conveyor belts of this type for the simultaneous weighing and transport of a material are known per se and will not be described further here.

In order to permit the reliable and rapid feeding of aggregates through the loading means to the weighing conveyor belt, the invention provides for each loading means to be formed by a hopper which is arranged above the weighing conveyor belt, which tapers downwards and, upwards, opens wide towards an openable hatch in chat side wall of the metering-unit container which is at the too when operating. In this way, aggregates can be introduced into the top opening of the hopper, for example by means of a wheeled loader, without attention having to be paid to particular precision during this filling operation.

It is possible to put only aggregates with a specific grain size into each hopper. These different aggregates can then be let out one after another onto the weighing conveyor belt, which weighs the aggregates of each grain size and ensures that they are metered in a predetermined ratio. However, it is also possible to perform the desired mixing of the aggregates with various grain sizes outside the metering-unit container and to put this mixture into each hopper of the metering-unit container.

A further simplification of this filling operation, as well as the possibility of simultaneous filling using a number of wheeled loaders, is provided if each metering-unit container is assigned a stackable metering container of essentially the same length, whose halves, when operating, are placed beside each other and parallel to the metering-unit container, oriented with the latter, and which, with the aid of a baffle-plate device and openable hatches in the upper side wall of the metering-unit container and in the lower wall of each half of the stackable metering container, enlarge the effective upper filling cross section of each hopper in the metering-unit container.

In this embodiment, provision is preferably made for the baffle-plate device to comprise baffle plates which are permanently arranged in the stackable metering container and run obliquely and which, in the operating state, lengthen the walls of each hopper in the metering-unit container upwards into the halves of the stackable metering container. By means of this measure, the upper filling cross section of each hopper in the metering-unit container can be approximately doubled by comparison with a design without a stackable metering container.

A further enlargement of the upper filling cross section of each hopper may be achieved if the baffle-plate device further comprises baffle plates which are rotatably mounted essentially at corners of the halves of the stackable metering container and, in the operating state, are folded out of the stackable metering container in such a way that they enlarge the hopper opening at the top. Overall, this permits an upper filling cross section to be achieved which allows the simultaneous filling of the metering device for aggregates using a number of wheeled loaders.

In order to convey onwards the aggregates metered and transported with the aid of the weighing conveying belt, the invention provides that, in the metering-unit container, an output conveying means is provided which runs underneath the weighing conveying belt, parallel to the latter, and can be displaced in the longitudinal direction, partly out of the metering-unit container, through an openable hatch in an end face of the metering-unit container. During transport, this output conveying means is accommodated completely in the metering-unit container and, for the purpose of operation, is drawn out through the opened hatch in the end face of the metering-unit container.

For the reasons already mentioned above for aggregates, the output conveying means can be a conveyor belt here as well.

For the onward transport of the aggregates, provision is preferably made, according to the invention, for the end of the output conveying means which, in the operating state, is located outside the metering-unit container to be arranged above the inclined conveying means for feeding aggregates to the stackable mixer container. The aggregates therefore fall onto the above-described inclined conveying means at that end of the output conveying means which is located outside the metering-unit container. In this case, in order to avoid as far as possible aggregates "falling by the wayside", a hopper can be arranged at the lower end of the inclined conveying means.

In a development of the invention, the transportable concrete mixing plant can also comprise an additive container to accommodate concrete additives. The selection of such additives depends on the intended use of the concrete to be produced, as known in civil engineering.

In a development of the transportable concrete mixing plant according to the invention, provision is made for it also to contain a control-station container, in which a control station for controlling the components of the concrete mixing plant is accommodated. Control stations of this type for the essentially computer-aided monitoring and control of concrete mixing plant are known in civil engineering and will not be explained further here.

In addition, the concrete mixing plant according to the invention can also comprise a water container to hold the water needed for the production of concrete, or a container which accommodates water and/or concrete additives.

As a result of covering, insulation, partitioning, warming or heating (with warm air, heating steam, heating coils and so on) of the individual mixing plant components (in particular the mixer container together with the stackable mixer container, conveyor belts, metering-unit container, additive container and water container together with delivery lines), the transportable concrete mixing plant according to the invention makes mixing operation possible even at ambient temperatures below zero degrees Celsius.

In a development of the transportable concrete mixing plant according to the invention, provision can be made for it to have a pressure conveying device, preferably a compressed-air conveying device, for conveying by pressure from at least one silo container. A pressure conveying device of this type is particularly advantageous when other conveying devices, such as feed screws, are subjected to high wear and/or a high risk of blockage because of the respective operating conditions, for example because of the binder or additive selected. The principle of pressure conveyance of such materials is known per se and can also be used for putting binders or additives into a silo container.

In an advantageous refinement of a pressure conveying device of this type, provision is made for it to comprise a collecting vessel with a compressor and a delivery hose connected to the collecting vessel. Of course, these components of the pressure conveying device can also be accommodated in a container during transport.

In principle, in the case of this construction it is possible to convey binders and additives through the delivery hose directly to a binder hopper in a stackable mixer container. However, since the pressure conveyance of materials of this type into a binder hopper could falsify the weighing of the material carried out therein, provision is advantageously made for the concrete mixing plant according to the invention to have at least one intermediate binder container for the intermediate storage of binder, which is preferably erected on at least one stackable mixer container, the delivery hose expediently opening into the at least one intermediate binder container. In this case, an intermediate binder container of this type erected on a stackable mixer container likewise has hatches through which the delivery hose opens into the said container when the transportable concrete mixing plant according to the invention is operating, or through which the material conveyed in can be fed to a binder hopper associated with a mixer.

This feeding is preferably carried out in such a way that the at least one intermediate binder container contains a hopper, which opens into a rotary feeder which is arranged above a binder compartment in a stackable mixer container. A rotary feeder of this type functions in a similar way to a rotating door provided in buildings and permits the feeding of binder or additive into the binder compartment without pressure being applied by the pressure conveying device. Rotary feeders of this type are known per se in this branch of engineering and will therefore not be explained specifically.

In a particularly space-saving embodiment of the invention, provision is made for the collecting vessel and the compressor to be arranged in the lower region of the silo container. In this case, the collecting vessel can be installed permanently in the respective silo container, while the compressor and the delivery hose are transported in the same container or in a different container when the concrete mixing plant is being transported. However, it is also possible to arrange the collecting vessel outside the silo container, in order to use this container as effectively as possible for the intermediate storage of binder or additive.

In a development, the transportable concrete mixing plant according to the invention can have binder silo containers and/or additive silo containers which, when operating, are stacked on one another and parallel to one another with essentially horizontal orientation. A "horizontal" orientation of silo containers in this way, with the container longitudinal axis running essentially horizontally, certainly requires an increased amount of space by contrast with the abovementioned vertical orientation of silo containers but permits the silo containers to be erected more stably and better protected against any possible tilting. Such a horizontal arrangement of silo containers can therefore be provided, for example, on building sites on which increased stability requirements have to be placed on the silos because of severe winds.

In order to form a continuous binder or additive silo from silo containers of this type stacked on one another and parallel co one another with essentially horizontal orientation, these silo containers can in turn be equipped with openable hatches. Since, when a silo container with a relatively large base area is stacked parallel one on another on a top surface which is aligned in parallel and is of essentially the same size and belongs to a silo container arranged underneath, and the size of conventional openable hatches in container surfaces is generally restricted, in order to ensure a good flow of binder or additive from upper to lower silo containers, provision is advantageously made for the binder silo containers and/or additive silo containers stacked on one another and parallel to one another with essentially horizontal orientation to each have removable bottom and top surfaces. In the case of such silo containers, therefore, when the concrete mixing plant according to the invention is operating, not only are hatches opened in the bottom and top surfaces of the containers, but rather these bottom and top surfaces are removed completely. This avoids the occurrence of corners and niches within a silo, in which binders or additives could accumulate.

Since even a silo constructed in this way must be closed at the top and bottom when operating, provision is expediently made for the transportable concrete mixing plant to have a final silo container which can essentially be divided into two halves and whose halves, when operating, form the lowest and, respectively, the uppermost container of a group of silo containers stacked on one another and parallel to one another. In this case, the dividable final silo container can accommodate those components which the lowest and uppermost container are intended to contain when the plant is operating. Thus, the uppermost container of the silo may have a filter which filters binders and/or additives out of the air expelled when filling the silo. The lowest container can contain the components already described above which are necessary in order co convey binders and/or additives out of the silo, for example by means of a feed screw or a pressure conveying device.

Alternately or preferably in addition to the described use of silo containers or intermediate binder containers, which serve as containers for concrete raw materials, in an advantageous development of the transportable concrete mixing plant according to the invention, provision can be made for at least one intermediate binder vessel for the intermediate storage of binder to be arranged in a stackable mixer container, a binder delivery means, preferably a binder feed screw, for delivering binder from at least one intermediate binder container into a binder compartment advantageously being arranged in the stackable mixer container. This ensures that the transportable concrete mixing plant according to the invention can continue to work even when the feed of binder from one or more silo containers or intermediate binder containers is temporarily interrupted, for example whilst they are being filled. In this case, the binder compartment in the stackable mixer container can be specifically supplied with binder from the intermediate binder vessel by the binder delivery means. It goes without saying that, depending on the relative arrangement of the binder compartment and the intermediate binder vessel, the binder delivery means can, for example, also be formed by a chute, a simple hose, a pressure conveying device or the like.

In order to be able to carry out the supplying of the mixer with binder and/or additives in the most flexible way, and in order in this way to be able to change flexibly between various binder supply states of the plant, provision is advantageously made for the transportable concrete mixing plant according to the invention to be designed to deliver binder and/or additives from a silo container and/or a transport vehicle into an intermediate binder vessel and/or an intermediate binder container, preferably having a feed-screw arrangement and/or a pressure conveying device. The feed-screw arrangement and/or the pressure conveying device, as described above, can be fitted in a stationary manner on or in one or more silo containers, in order to convey binder or additives from the silo into an intermediate vessel in a stackable mixer container or into an intermediate container which is erected on a stackable mixer container. However, a feed-screw arrangement or pressure conveying device of this type can also be provided separately from the silo containers when the plant is operating, in order to convey binders or additives directly from heavy goods vehicles which deliver the appropriate substances.

In a practical implementation of the transportable concrete mixing plant according to the invention, provision can be made for a mixer container, when the plant is operating, to be set up on its ends on at least one other container in each case in such a way that concrete can be let out through the openable hatches for removing concrete from the mixer container into a heavy goods vehicle or the like provided under the mixer container. AS in the case explained above of erection on a mixer frame, in the case of such an erection of the mixer container, the concrete prepared in the mixer can also be let out directly into the heavy goods vehicle provided. In addition, mixer containers having a number of mixers, which may be too heavy to be placed on a mixer frame, can be erected safely and without stability problems in the manner described with their ends on at least one other container in each case. It goes without saying that the at least two other containers on which a mixer container of this type is erected can be formed by virtually any other containers of the concrete mixing plant according to the invention, for example by control-station containers and/or water containers and/or containers for concrete additives.

The invention further relates to the use of a container, preferably a standard shipping container, especially in the transportable concrete mixing plant described above, as a binder silo. A binder silo of this type in the form of a container can be transported without difficulties over great distances, using marine freighters, goods trains, heavy goods vehicles and so on. Furthermore, the use of containers as binder silos offers the possibility of combining a number of containers, generally stacked on one another, to form larger silos.

In addition, the invention relates to a method of securing a binder or additive silo, preferably a container used as a binder silo, in a concrete mixing plant against falling over, in which method the binder silo is fastened by means of transverse struts to components of the concrete mixing plant. This type of fastening leads to greater stability than the conventional fastenings to the ground and thus reduces the risk of a largely emptied binder silo falling over in the event of severe wind or other vibration.

Furthermore, the invention relates to a conveying means, preferably a conveyor belt, having a conveying direction which can be changed over optionally and which can also be moved to and fro in the longitudinal direction between various operating positions. A conveying means of this type represents a quick-acting and space-saving device for distributing materials from a feed device to a number of holding devices, especially more than two holding devices arranged essentially beside one another.

Furthermore, the invention relates to a metering attachment for enlarging the effective catching cross section of a hopper of a metering unit, preferably of the metering-unit container in the above-described transportable concrete mixing plant, which is characterized by the fact that the metering attachment is formed by a stackable metering container which can be divided into two halves and whose halves, stacked beside each other on the metering unit, extend the inclined walls of the hopper upwards by means of fixed baffle plates in the interior of the halves and baffle plates which can be folded outwards. The enlargement effected hereby of the effective catching cross section of the hopper reduces the risk of the material to be put in "falling by the wayside", and thus permits the rapid filling of the hopper and simultaneous filling with the aid of a number of feed devices, for example in the form of wheeled loaders.

The invention will be explained in the following text using exemplary embodiments and with reference to the drawing, in which.

For the purpose of simpler and clearer illustration, those containers which contain components described below are in each case illustrated in the figures as being open towards the observer, that is to say that side or end wall of the container pointing towards the observer has been taken off.

Figure 1:
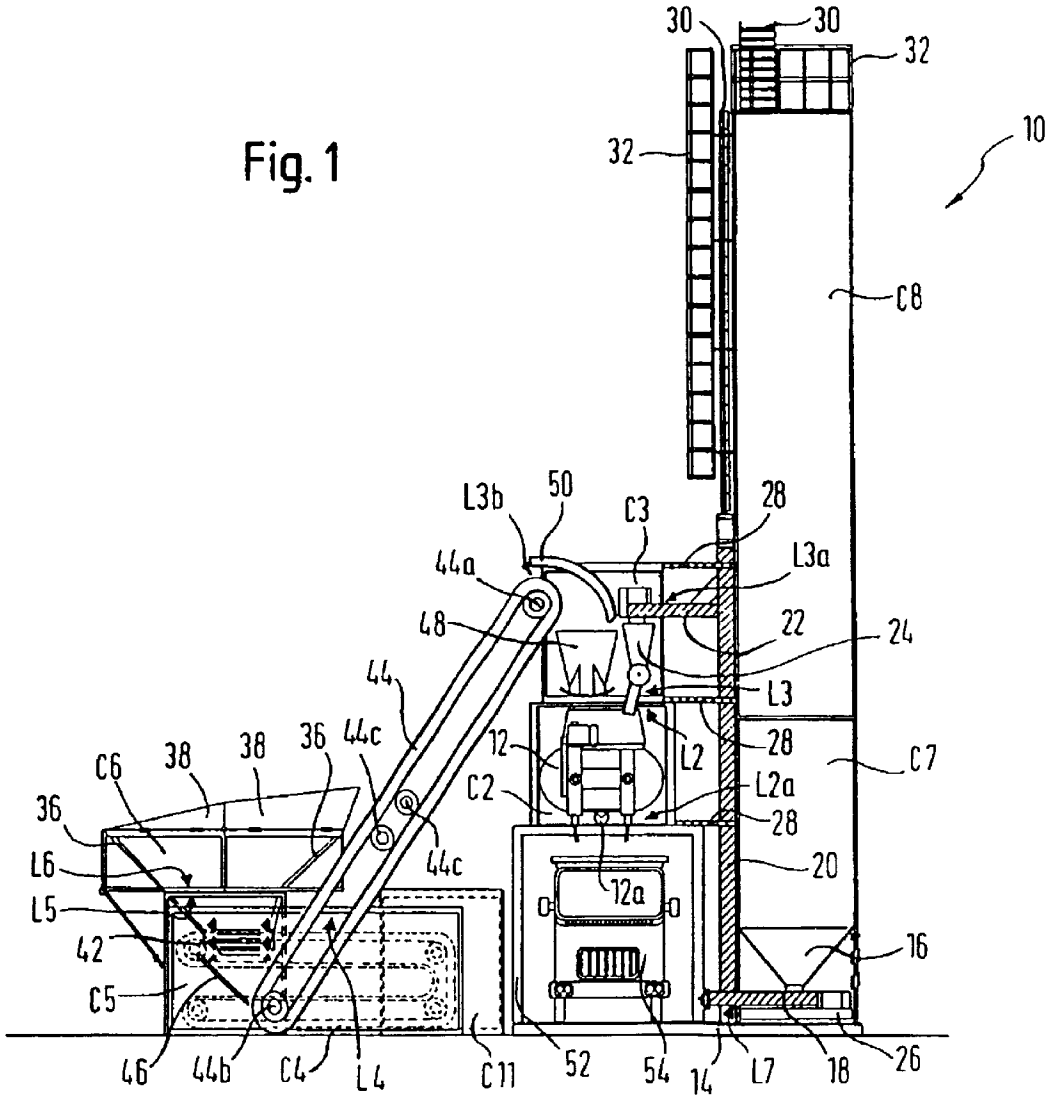
FIG. 1 shows a side view of a first embodiment of the transportable concrete mixing plant according to the invention with a mixer operating.

FIG. 1 shows a side view of a first embodiment of the concrete mixing plant according to the invention, in which one mixer 12 is used. In FIG. 1, it is possible to see, on the right, a lower binder silo container or additive silo container C7 which has been erected on a baseplate 14 vertically on one end face, on which an upper silo container C8 has been placed, likewise oriented vertically. By opening hatches in the end faces of the containers C7 and C8 resting on one another, a continuous relatively large silo can be formed by said containers. In the case of these openable hatches, as well as those provided in other containers, it is not important whether these are opened by folding a hatch door away, sliding it laterally or removing it completely. For this reason, the construction of openable hatches is not extensively described in the further course of this document.

The lower silo container C7 has, in the region of its lower end in FIG. 1, a hopper 16 which opens onto a lower feed screw 18. The latter passes through the side wall (on the left in FIG. 1) of the lower silo container C7, through a hatch L7, and conveys binder or additive from it to a vertical feed screw 20, which is fixed to the side wall (on the left in FIG. 1) of the lower silo container C7 and of the upper silo container C8 and there runs essentially upwards. In the lower region of the upper silo container C8, the vertical feed screw 20 works together with an upper feed screw 22 and transfers binder or additive to the latter for onward transport.

The upper feed screw 22 passes through the side wall (on the right in FIG. 1) of the stackable mixer container C3, through an openable hatch L3*a* provided in this side wall, and ends over a binder compartment 24 provided in the stackable mixer container C3, into which compartment the binder or additive delivered by the upper feed screw 22 falls. By means of opened hatches L3 and L2 in the lower bottom wall of the stackable mixer container C3 and in the upper top wall of the mixer container C2, standing underneath the stackable mixer container C3, the binder compartment 24 feeds binder or additive in metered fashion to the mixer 12 arranged in the mixer container C2, for which purpose a balance may be incorporated in the binder compartment 24.

As can be seen in FIG. 1, in the embodiment shown, various means are provided for increasing the stability of the binder silo: on the one hand, a concrete slab 26 is fastened to the lower end face on which the lower silo container C7 stands. On the other hand, the lower silo container C7 and the upper silo container C8 in FIG. 1 are fastened by a number of transverse struts 28 to the stackable mixer container C3 and to the mixer container C2.

In addition to the safe erection of the binder silo, in order also to permit safe work at and on this silo, a number of ladders 30 and railing devices 32 are provided on the upper silo container C8.

Figure 8:
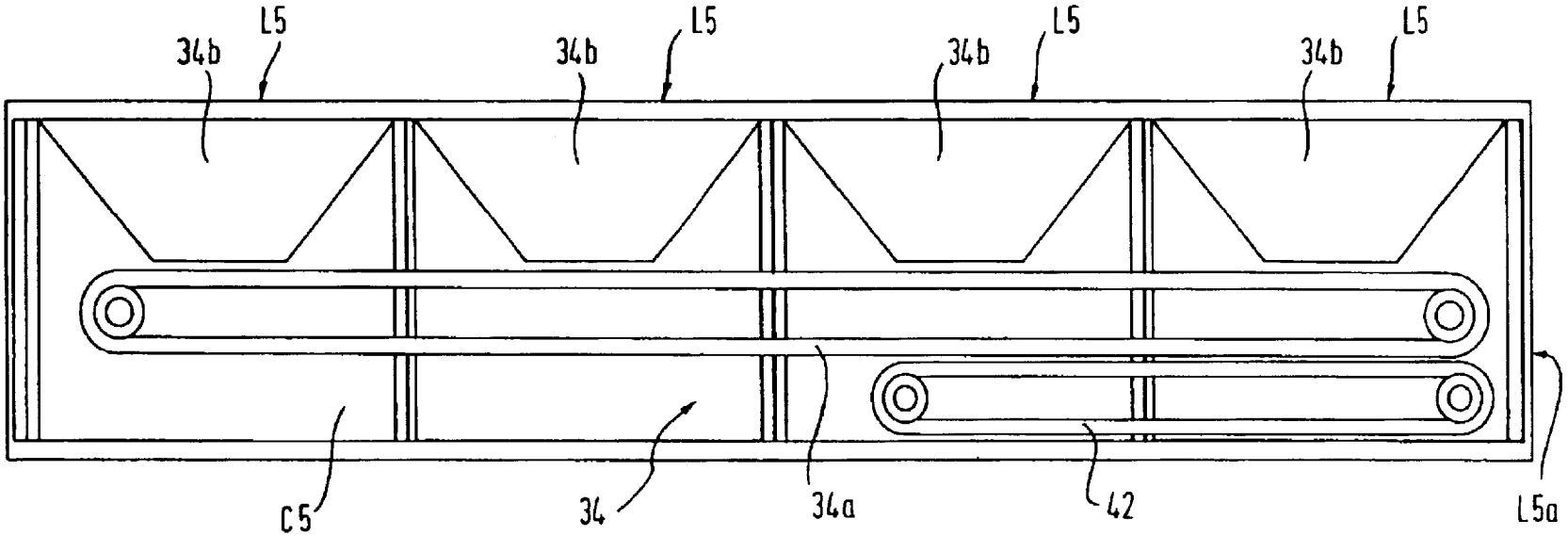
FIG. 8 shows a side view of the metering-unit container of the transportable concrete mixing plant according to the invention during transport.
Figure 9:
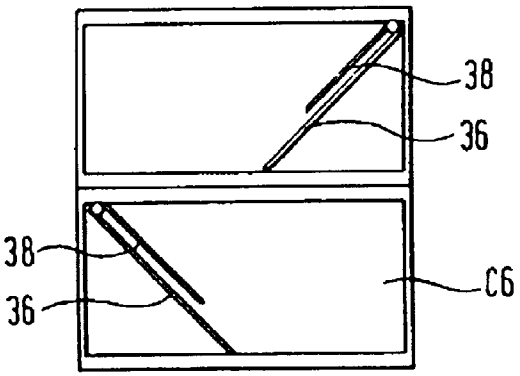
FIG. 9 shows a front view of the stackable metering container of the transportable concrete mixing plant according to the invention during transport.

The metered feeding of aggregates to the mixer 12 during the operation of the transportable concrete mixing plants 10 according to the invention begins in a metering-unit container C5, which has a metering device 34 for metering the aggregates. As can be seen in FIG. 8, the metering device 34 for aggregates comprises a weighing conveyor belt 34*a* for weighing and transporting the aggregates and a number of loading means 34*b* for feeding the aggregates to the weighing conveyor belt 34*a*. As can be seen in FIG. 8, each loading means 34*b* is formed as a hopper, which tapers downwards and opens wide upwards to form an openable hatch in the side wall (at the top in FIGS. 1 and 8) of the metering-unit container C5. It is therefore not necessary for the aggregates, which are generally brought up in great quantities by wheeled loaders, to be deposited precisely on the weighing conveyor belt 34*a*, which is relatively narrow by comparison with the metering-unit container C5; instead they can simply be thrown, at the top in FIG. 8, into the metering-unit container C5 over the entire side area of the latter, which reduces the risk of aggregates "falling by the wayside", and therefore permits rapid loading of the weighing conveyor belt 34*a*.

In the embodiment shown in FIG. 8 of the metering-unit container C5, each hopper 34*b* can be filled with a mixture, put together previously in the correct ratio, of aggregates of various granular groups. Alternately, each granular group can be assigned a specific hopper 34*b*, so that overall in this case, in the embodiment of the metering-unit container C5 shown in FIG. 8, aggregates having four different granular groups can be mixed.

In order to enlarge the upper filling cross section of each hopper 34*b* in the metering-unit container C5 further in such a way that, if appropriate, even the simultaneous feeding of aggregates using a number of wheeled loaders is possible, the metering-unit container C5 is assigned a stackable metering container C6 of essentially the same length. This stackable metering container C6, when operating, is broken down or folded open into two halves, which are stacked on the metering-unit container C5, beside each other and parallel to the said container. Fastened in the stackable metering container C6 are baffle plates 36 which run obliquely and which extend the walls of the hopper 34*b* through opened hatches L5 and L6 in the upper side wall of the metering-unit container C5 and in the lower side wall of each half of the stackable metering container C6. As can be seen in the side view of FIG. 1, this means that the effective filling width of the arrangement of hoppers 34 is essentially doubled, which corresponds to doubling the effective upper filling cross section of each hopper 34*b*.

In order to enlarge this filling cross section still further, additional baffle plates 38, which are rotatably mounted essentially at corners of the halves of the stackable metering container C6, are folded out upwards from the stackable metering container C6. The shape of these fold-out baffle plates 38 is in this case expediently matched to the direction from which the feeding of the aggregates is primarily to take place. Thus, the fold-out baffle plates 38 used in the embodiment of FIGS. 1 and 2 extend the opening of the hopper 34*b* essentially in the direction of the top right, since the feeding of aggregates by one or more wheeled loaders 40 is carried out essentially from the left, as illustrated in FIG. 2.

The aggregates fed through the hoppers 34*b*, which are enlarged upwards by the abovementioned baffle plates 36 and 38, fall onto the weighing conveyor belt 34*a* illustrated in FIG. 8, which, using an incorporated (not illustrated) balance, transports a previously determined rate of aggregates to a feed conveyor belt 42. When the metering-unit container C5 is being transported, as shown in FIG. 8, this feed conveyor belt 42 is accommodated under the weighing conveyor belt 34*a* and parallel to the latter. When the transportable concrete mixing plant 10 according to the invention is being operated, as shown in FIGS. 1 and 2, the feed conveyor belt 42 is drawn out through an opened hatch L5*a* in that end face of the metering-unit container C5 which is at the bottom in the plan view of FIG. 2. When operating in this way, the feed conveyor belt 42 projects sufficiently far under the weighing conveyor belt 34*a* that it can reliably accept the aggregates falling down at its end on the right in FIG. 8.

Figure 2:
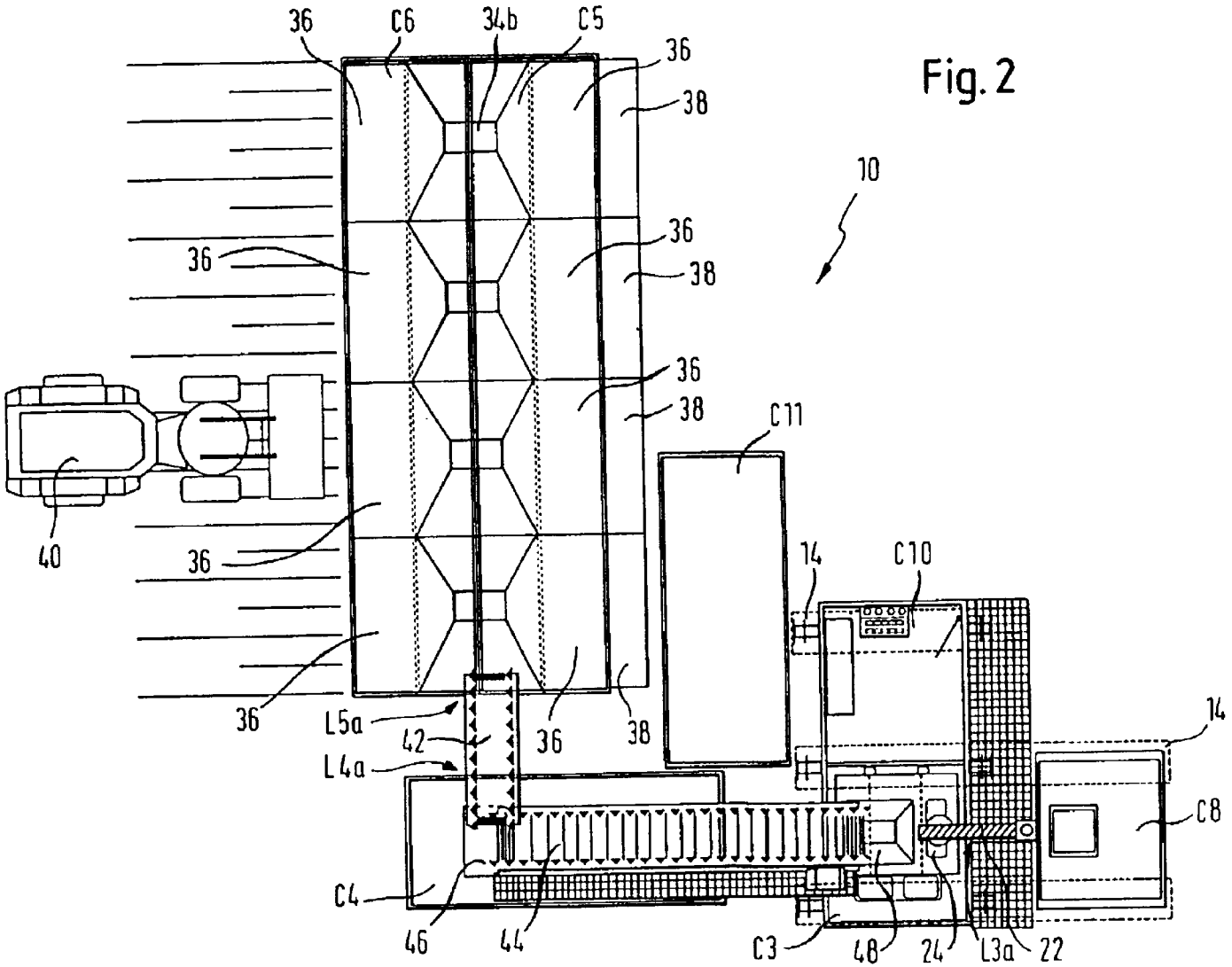
FIG. 2 shows a plan view of the concrete mixing plant according to FIG. 1.

As can be seen in FIGS. 1 and 2, that end of the feed conveyor belt 42 which is located outside the metering-unit container C5 is arranged above an inclined conveyor belt 44 for feeding the aggregates to the stackable mixer container C3. In order to prevent aggregates "falling by the wayside" at this end beside the inclined conveyor belt 44, the latter can expediently be provided at its lower end with an aggregate collecting device 46 designed as a baffle plate, chute or the like. As indicated by a dashed line in FIG. 1, when the concrete mixing plant according to the invention is being transported, the inclined conveyor belt 44 is completely accommodated, in the folded-up state, in an inclined conveyor-belt container C4. For the purpose of operation, one end of the inclined conveyor belt 44 is drawn out through an opened hatch L4 in the upper top wall of the inclined conveyor-belt container C4, and an upper deflection roller 44*a*, located at this end, is rotatably fastened to the stackable mixer container C3 in such a way that this end of the inclined conveyor belt 44 is located above the loading means 46 for aggregates arranged in the stackable mixer container C3. A lower deflection roller 44*b*, via which the drive to the inclined conveyor belt 44 is also expediently provided, is also arranged in the inclined conveyor-belt container C4. For the purpose of stabilizing the inclined conveyor belt 44, further deflection rollers 44*c* can be provided, if required, between the upper deflection roller 44*a* and the lower deflection roller 44*b*, as indicated in FIG. 1.

In order to avoid scattering losses at the upper end of the inclined conveyor belt 44, in the region of the upper deflection roller 44*a*, as aggregates fall down into the pilot silo 48 above the mixer 12, a baffle plate 50 can be fastened to the stackable mixer container C3 in such a way that it guides the aggregates conveyed up by the inclined conveyor belt 44 into the pilot silo 48.

As FIG. 1 reveals, the mixer container C2 containing the mixer 12 is erected on a standing face of a mixer frame 52, which stands on the baseplate 14 alongside the lower binder silo container C7. This mixer frame 52 is dimensioned such that concrete produced by the mixer 12 can be let out through a lower bottom emptying opening 12*a* of the mixer 12, and opened hatches L2*a* in the bottom surface of the mixer container C2, into a heavy goods vehicle 54 provided under the standing surface. With the aid of one or more heavy goods vehicles 54 of this type, the freshly produced concrete can be transported to the respective point of use on the building site.

The first embodiment, shown in FIGS. 1 and 2, of the transportable concrete mixing plant according to the invention further comprises a water and/or additive container C11 which is erected separately. The feeding of water and/or additive to the mixer 12 with the aid of pumps and an arrangement of pipelines or hoses is known per se in concrete mixing plant, and will therefore not be discussed specifically.

As can be seen in the plan view of FIG. 2, in this first embodiment, the stackable mixer container C3 and the control container C10 are put together to form one container, preferably a standard shipping container, which has the same dimensions as the mixer container C2 on which it stands. It is of course also possible to separate the containers C3 and C10 from each other when they are operating, for example in order to erect the control container C10 at a different location which offers a better overview of the concrete mixing plant 10 according to the invention. Alternatively, it is of course also possible to incorporate the components of the concrete mixing plant according to the invention which are normally accommodated in different containers C3 and C10 into a single container from the start.

Figure 3:
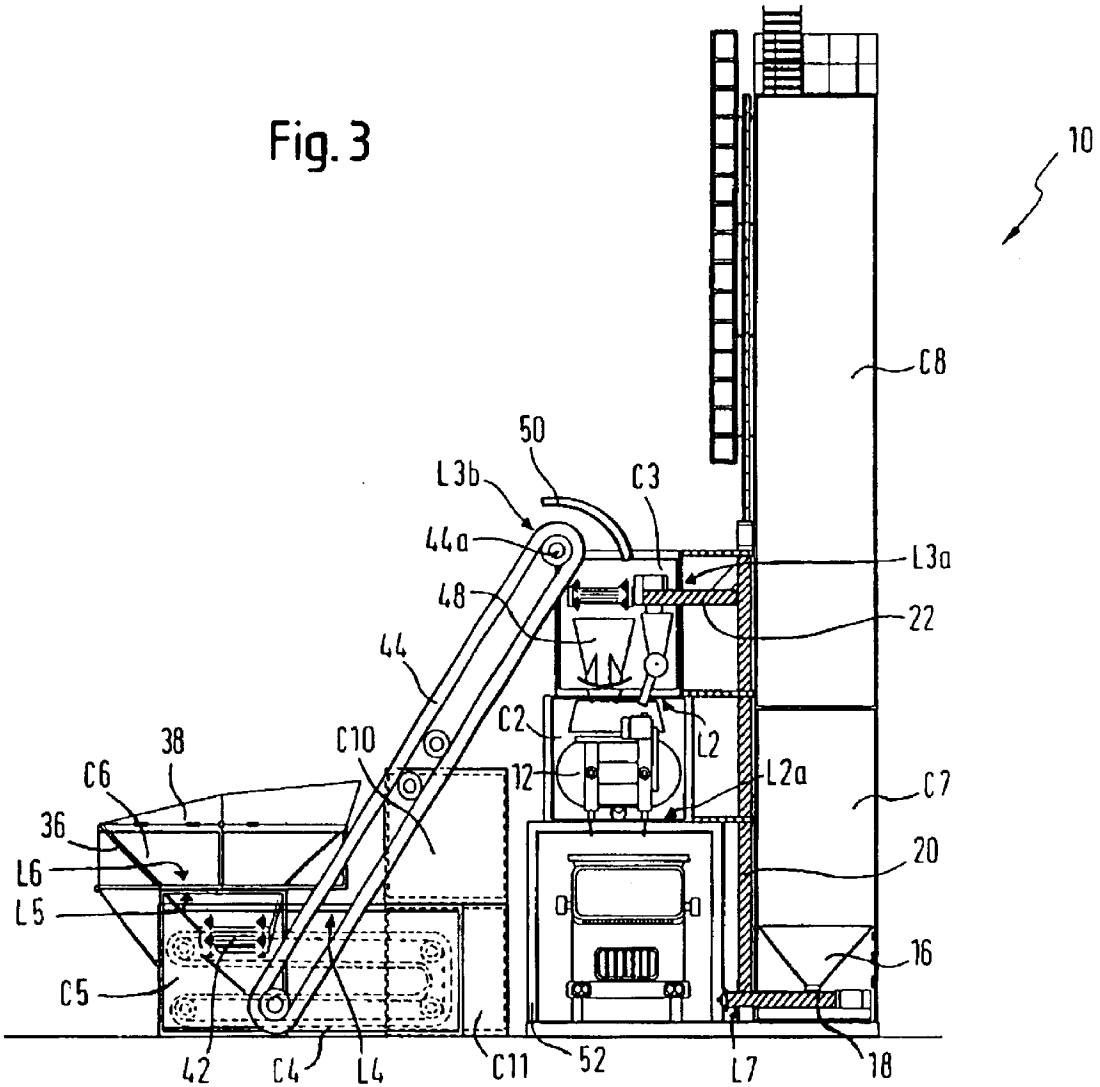
FIG. 3 shows a side view of a second embodiment of the transportable concrete mixing plant according to the invention with two mixers operating.
Figure 4:
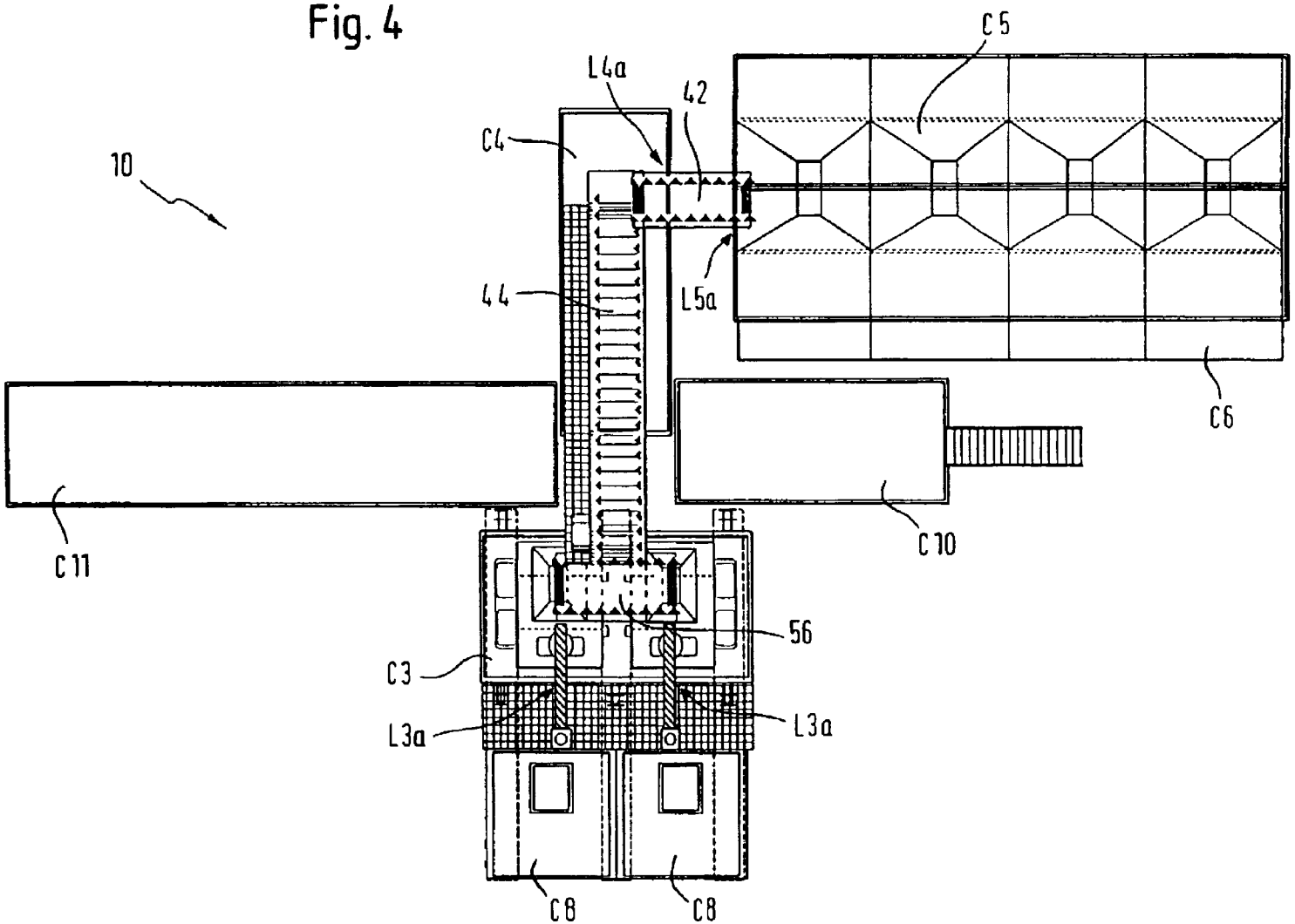
FIG. 4 shows a plan view of the concrete mixing plant according to FIG. 3.

A second embodiment of the transportable concrete mixing plant according to the invention is shown in FIGS. 3 and 4. By comparison with the embodiment shown in FIGS. 1 and 2, this embodiment permits greater concrete production, since it uses two mixers. Components of this second embodiment which are identical or functionally identical to the components of the first embodiment are provided with the same reference symbols in FIGS. 3 and 4 as in FIGS. 1 and 2.

In the second embodiment, shown in FIGS. 3 and 4, the mixer container C2 has two preferably identical mixers 12. In order to supply these two mixers 12 with binder, all the components serving this purpose in the first embodiment are provided in duplicate in the second embodiment. It is therefore possible to see, in FIGS. 3 and 4, two lower silo containers C7, on which in each case upper silo containers C8 stand. As in the first embodiment, in each case a lower silo container C7 and an upper silo container C8 form a larger silo, from which in each case a mixer 12 is supplied with binder via, respectively, a hopper 16, a lower binder feed screw 18, a binder vertical feed screw 20, an upper binder feed screw 22 and a binder compartment 24, optionally provided with a balance, in a stackable mixer container C3.

The feeding of aggregates to two pilot silos 48 for aggregates, each of which is assigned to a mixer 12, is also firstly carried out in the second embodiment of the concrete mixing plant 10 according to the invention via a stackable metering container C6, provided with baffle plates 36, 38, a metering device 34 accommodated in a metering-unit container C5 and having loading means 34*b* and a weighing conveyor belt 34*a*, as well as a feed conveyor belt 42, which transports the aggregates to an inclined conveyor belt 44.

In order to be able to distribute the aggregates falling down at the upper end of the inclined conveyor belt 44, in the region of its upper deflection roller 44*a*, to the two pilot silos 48 for aggregates, there is installed in the stackable mixer container C3 an aggregate conveyor belt 56, running essentially horizontally, whose ends are in each case arranged above one of the two pilot silos 48. The running direction of the aggregate conveyor belt 56 can be changed over optionally, so that the aggregates falling from the inclined conveyor belt 44 can optionally be fed to ore of the two pilot silos 48, depending on the operating state of the two mixers 12 and of the filling level of the aggregates in the pilot silos 48.

In the second embodiment of the concrete mixing plant according to the invention, shown in FIGS. 3 and 4, the mixer container C2 containing the two mixers 12 also stands on a standing surface of a mixer frame 52. It is therefore possible in this embodiment as well for concrete to be let out of each mixer 12 into a heavy goods vehicle or, if appropriate, even a number of heavy goods vehicles standing "back to back", that is to say with their rear ends oriented towards each other.

It is also possible to see, in FIGS. 3 and 4, that the control container C10, by contrast with the first embodiment of FIGS. 1 and 2, is now erected on the additive container C9, instead of on the mixer frame 52, for reasons of space. Of course, the control container C10 can also be erected at any other location which offers a good overview of the concrete mixing plant 10 according to the invention.

Figure 5:
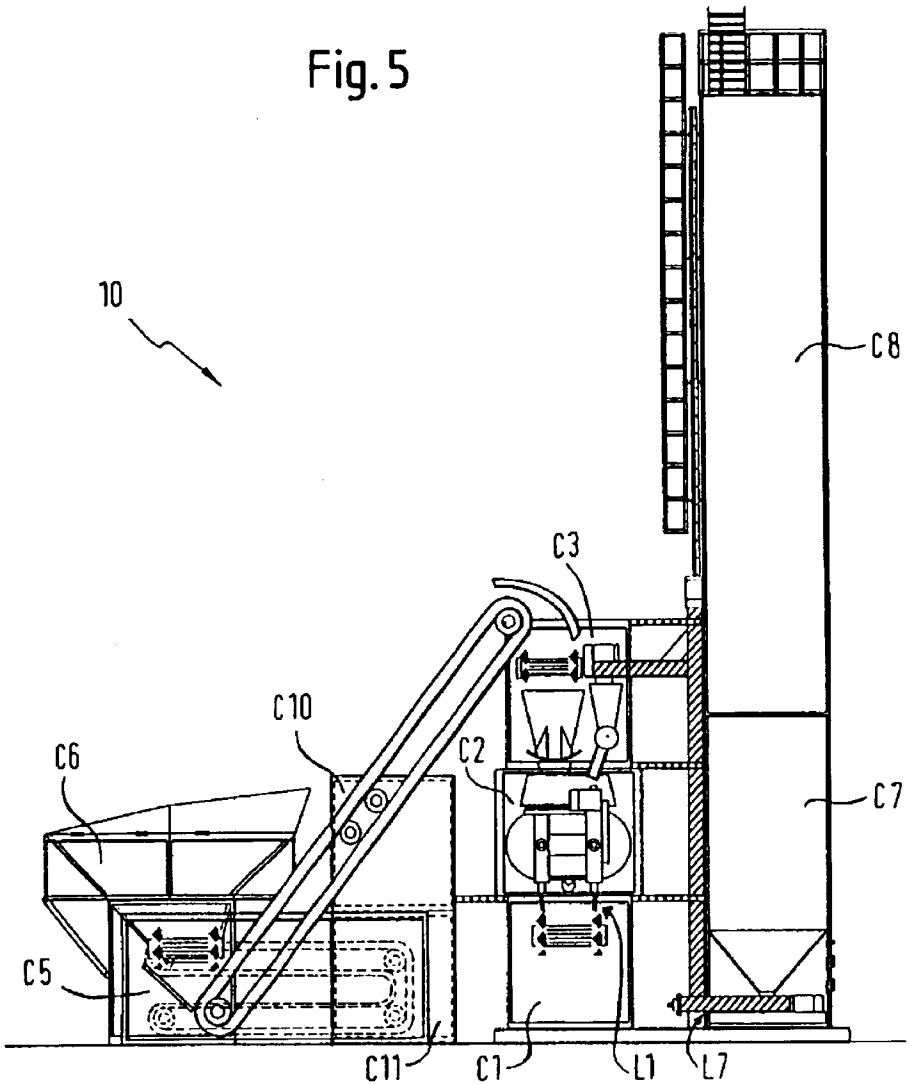
FIG. 5 shows a side view of a third embodiment of the transportable concrete mixing plant according to the invention with four mixers operating.
Figure 6:
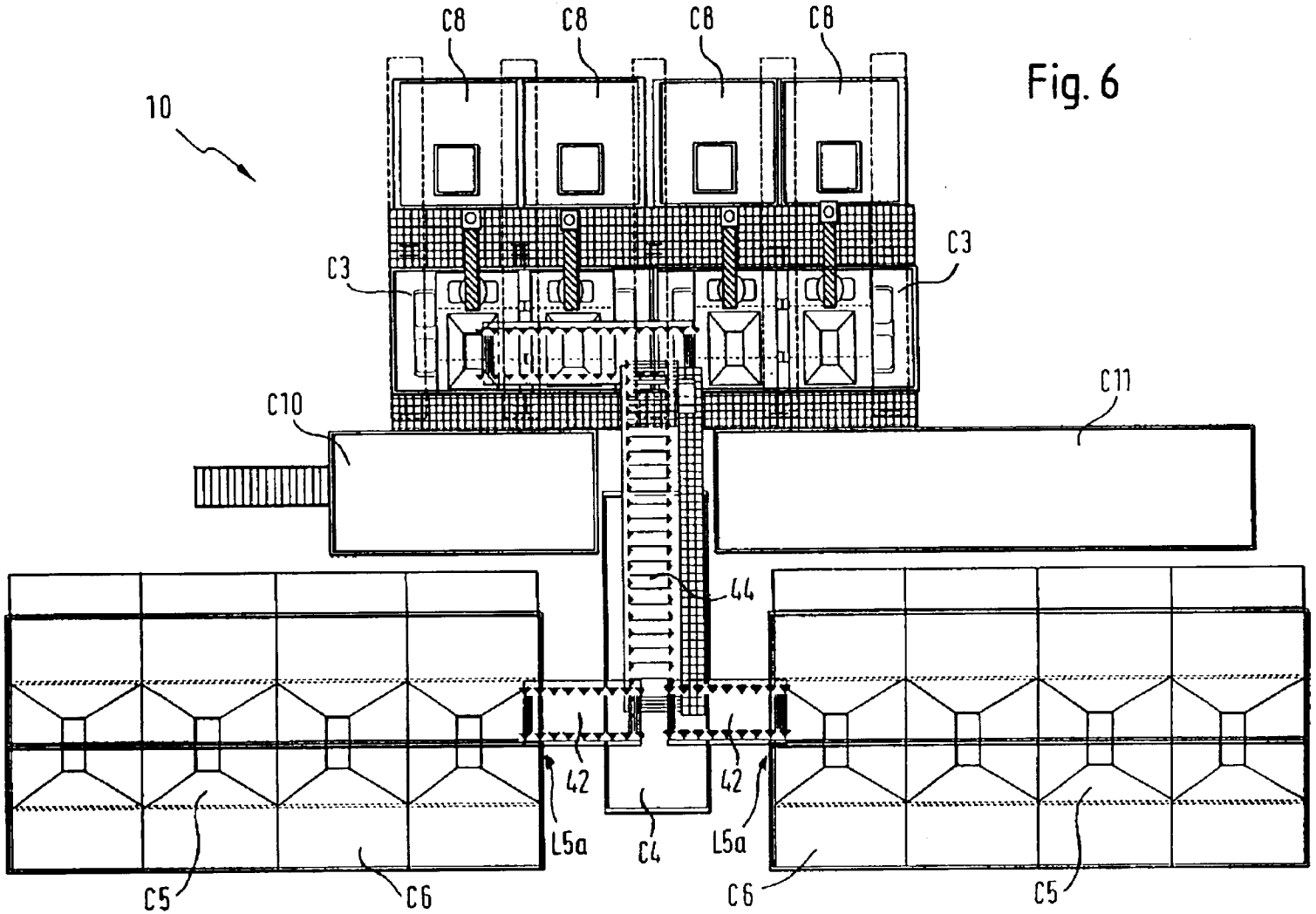
FIG. 6 shows a plan view of the concrete mixing plant according to FIG. 5.
Figure 7:
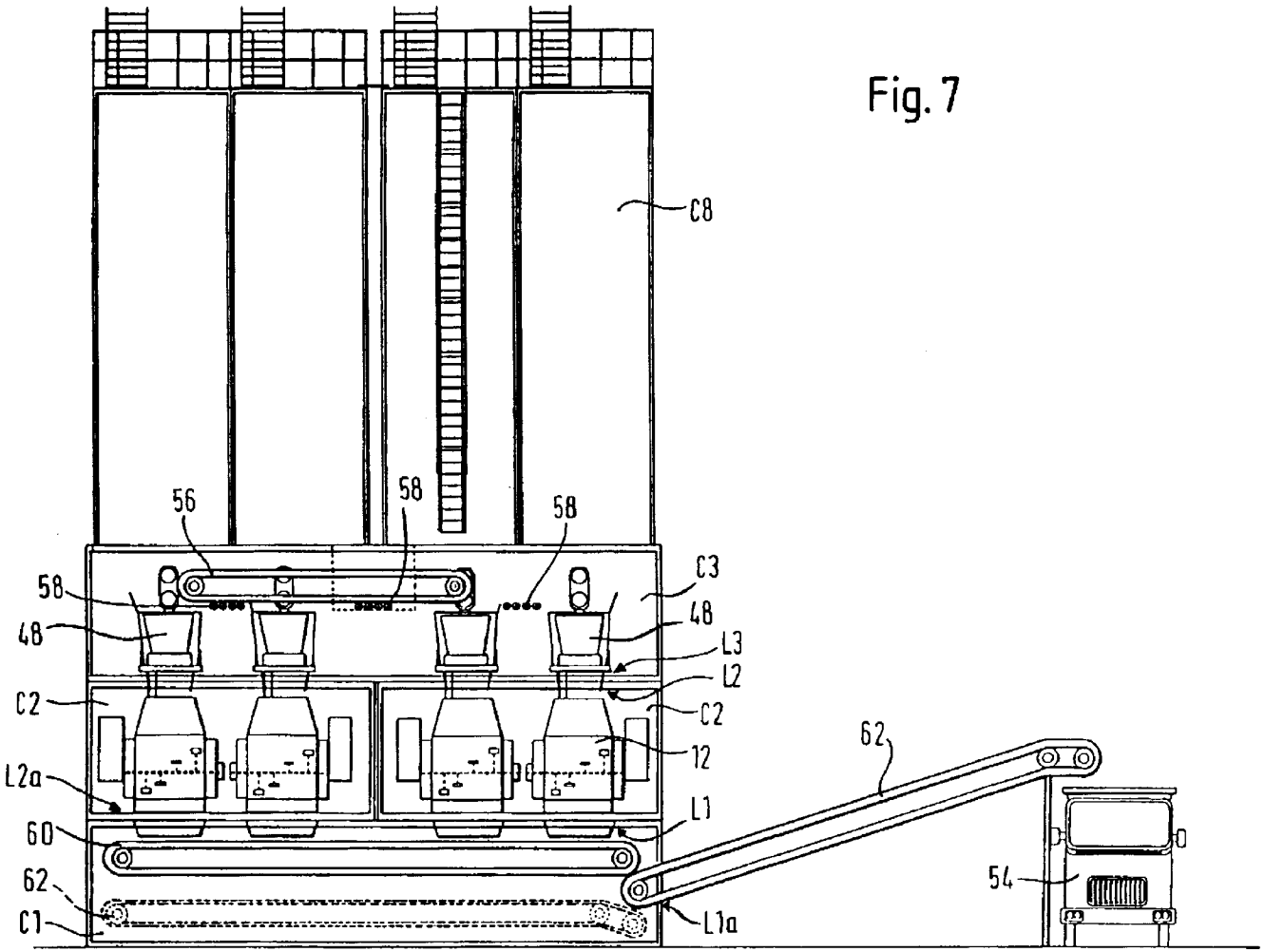
FIG. 7 shows a part front view of the concrete mixing plant according to FIG. 5.

A third embodiment of the transportable concrete mixing plant according to the invention is illustrated in FIGS. 5 to 7. This embodiment is envisaged for large building sites, in which a particularly large amount of concrete is needed. For this reason, the embodiment of the concrete mixing plant 10 according to the invention which is shown in FIGS. 5 to 7 contains two mixer containers C2, each of which contains two mixers 12. In operation, the two mixer containers C2, as can be seen in FIG. 6, are erected beside each other in such a way, and hatches in the adjacent end faces of the two mixer containers C2 are opened in such a way, that the total of four mixers essentially stand in a row. Erected on each mixer container C2 is a stackable mixer container C3, which is essentially identical to the stackable mixer container C3 shown in FIGS. 3 and 4 and therefore, for each mixer 12, contains a pilot silo 48 for aggregates and a binder compartment 24.

In the third embodiment, too, each mixer 12 is assigned a complete group of components for supplying with binder or additive, that is to say the silo containers C7 and C8 and the feed screws 18, 20 and 22.

In this third embodiment of the invention, in order to be able to cover the high requirement for aggregates, the group of components for the metering and feeding of aggregates which is known from the first two embodiments, comprising a stackable metering container C6, a metering-unit container C5 and the components which are accommodated in them during transport are present in duplicate here. As can be seen in FIG. 6, aggregates are thus fed to the inclined conveyor belt 44 by two feed conveyor belts 42.

In order to distribute the aggregates falling from the inclined conveyor belt 44 in the region of the upper deflection roller 44*a* to the four mixers 12, the conveyor belt, known from FIGS. 3 and 4, whose running direction can be changed over optionally is further developed in this embodiment to form an aggregate conveyor belt 56 which can be moved to and fro between a number of operating positions, in which each end of the aggregate conveyor belt 56 is assigned to a pilot silo 48 for aggregates. Thus, in FIG. 7, the aggregate conveyor belt 56 is located in an operating position in which, by changing over its running direction, it supplies the two pilot silos 48 for aggregates which are assigned to the two mixers 12, in each case on the left in FIG. 7, of each mixer container C2. By moving the aggregate conveyor belt 56 on rollers 58 indicated schematically in FIG. 7, it can be displaced into a second operating position, in which it supplies the two pilot silos 48 for aggregates which are assigned to the two mixers 12, in each case on the right in FIG. 7, of each mixer container C2.

Transporting the concrete produced away, in the third embodiment of the invention, illustrated in FIGS. 5 to 7, is carried out in a way which is different from the two firs embodiments, since the two mixer containers C2, containing a total of four mixers 12, cannot generally be placed on one mixer frame, for reasons of weight. Instead, the two mixer containers C2, as can be seen in FIG. 5, stand on an offloading container C1, in whose top wall there are provided openable hatches L1 which are located opposite the openable hatches L2*a* in the bottom wall of each mixer container C2. During the operation of the plant 10 according to the invention, concrete discharged from the mixers 12 falls through these opened hatches L2*a*, L1 onto an upper concrete collecting belt 60 accommodated completely in the offloading container C1. The concrete, conveyed in the running direction by this upper concrete collecting belt 60, falls, at the end of the upper concrete collecting belt 60, onto a lower concrete conveyor belt 62. This lower concrete conveyor belt 62 is likewise completely accommodated in the offloading container C1 when being transported, and for the purpose of operating the plant 10, is drawn out through an opened hatch L1*a* in the end wall of the offloading container C1 (on the right in FIG. 7) that, at its end remaining in the offloading container C1, it can reliably accept the concrete falling from the upper concrete collecting belt 60 and transport it to a heavy goods vehicle 54 provided beside the offloading container C1.

The arrangement of the lower concrete conveyor belt 62 within the offloading container C1 during transport is shown dashed in FIG. 7.

Figure 10:
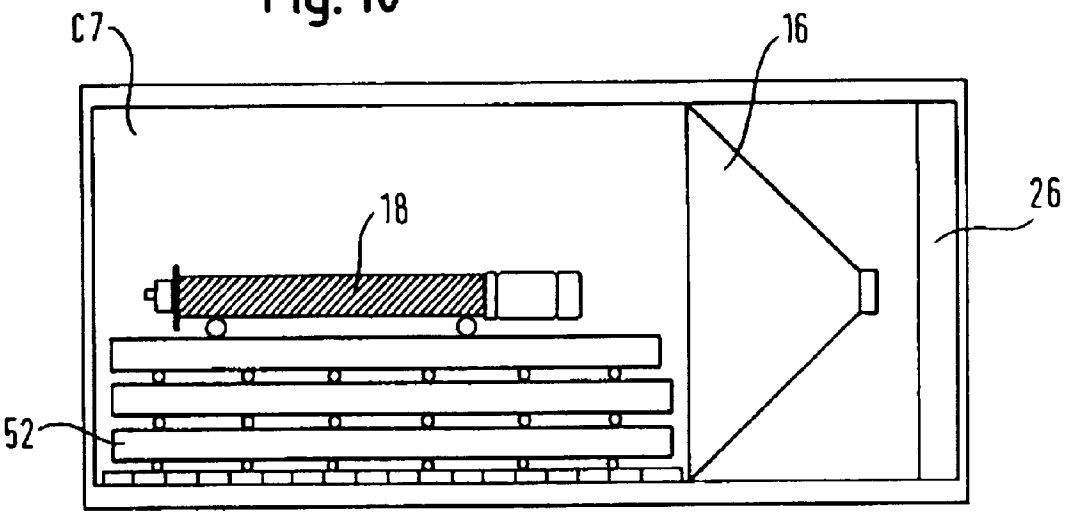
FIG. 10 shows a side view of a lower binder silo container of the transportable concrete nixing plant according to the invention during transport.

FIG. 10 shows a side view of the lower silo container C7 of the transportable concrete mixing plant 10 according to the invention, in which the front side wall has been removed in order to simplify the illustration. It is possible to see the hopper 16 fastened permanently in the lower silo container C7, as well as the concrete slab 26 permanently fastened to its end face (on the right in FIG. 10) for stabilization purposes. It is also possible to see a lower feed screw 18, accommodated in the container C7 for the purpose of transport, as well as a mixer frame 52 broken down into individual parts. It goes without saying that these components can be secured against slipping during transport by means of securing means (such as belts, not illustrated in FIG. 10).

Figure 11:
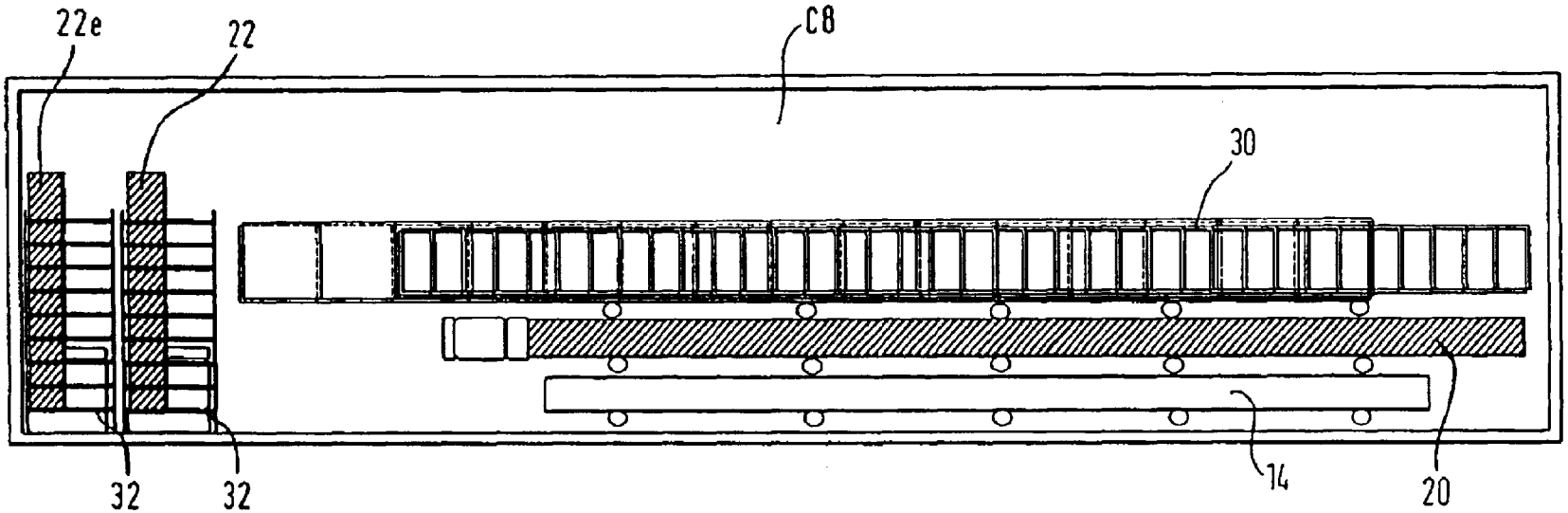
FIG. 11 shows a side view of an upper binder silo container of the transportable concrete mixing plant according to the invention during transport.

FIG. 11 shows a side view of an upper silo container C8 of the concrete mixing plant 10 according to the invention. During transport, this container C8 accommodates the baseplate 14, the vertical feed screw 20, the upper feed screw 22, a replacement screw 22*e*, the ladders 30 fastened to the upper silo container C8 during operation, and the railing device 32.

Figure 12:
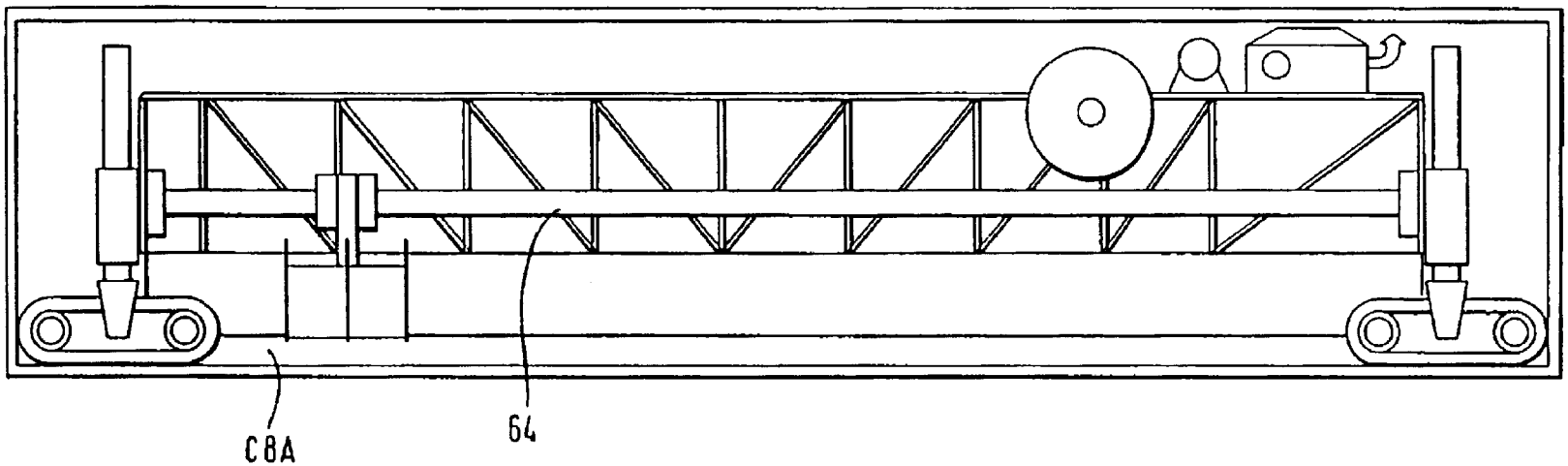
FIG. 12 shows a side view of a further upper binder silo container with a concrete finisher during transport.
Figure 13:
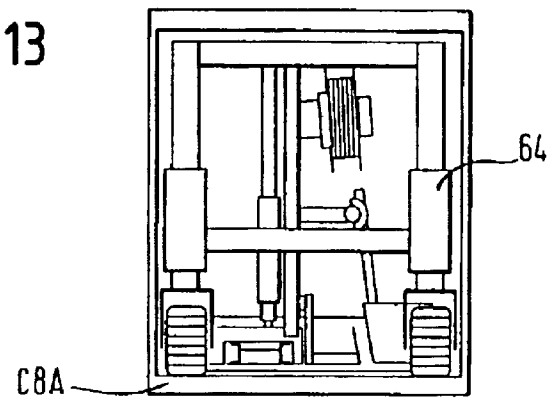
FIG. 13 shows a front view of the binder silo container according to FIG. 12.

FIGS. 12 and 13 show a side and front view, respectively, of a further upper silo container C8, the front side or end wall of the container again having been removed for clearer illustration. During transport, the container C8 accommodates a concrete finisher 64, which can be used on the building site for concreting streets, landing strips and the like. It goes without saying that in the containers which are also carried during transport, especially the upper binder silo containers C8, which are often carried along empty, it is optionally also possible for other articles needed on the building site to be carried as well.

Figure 14:
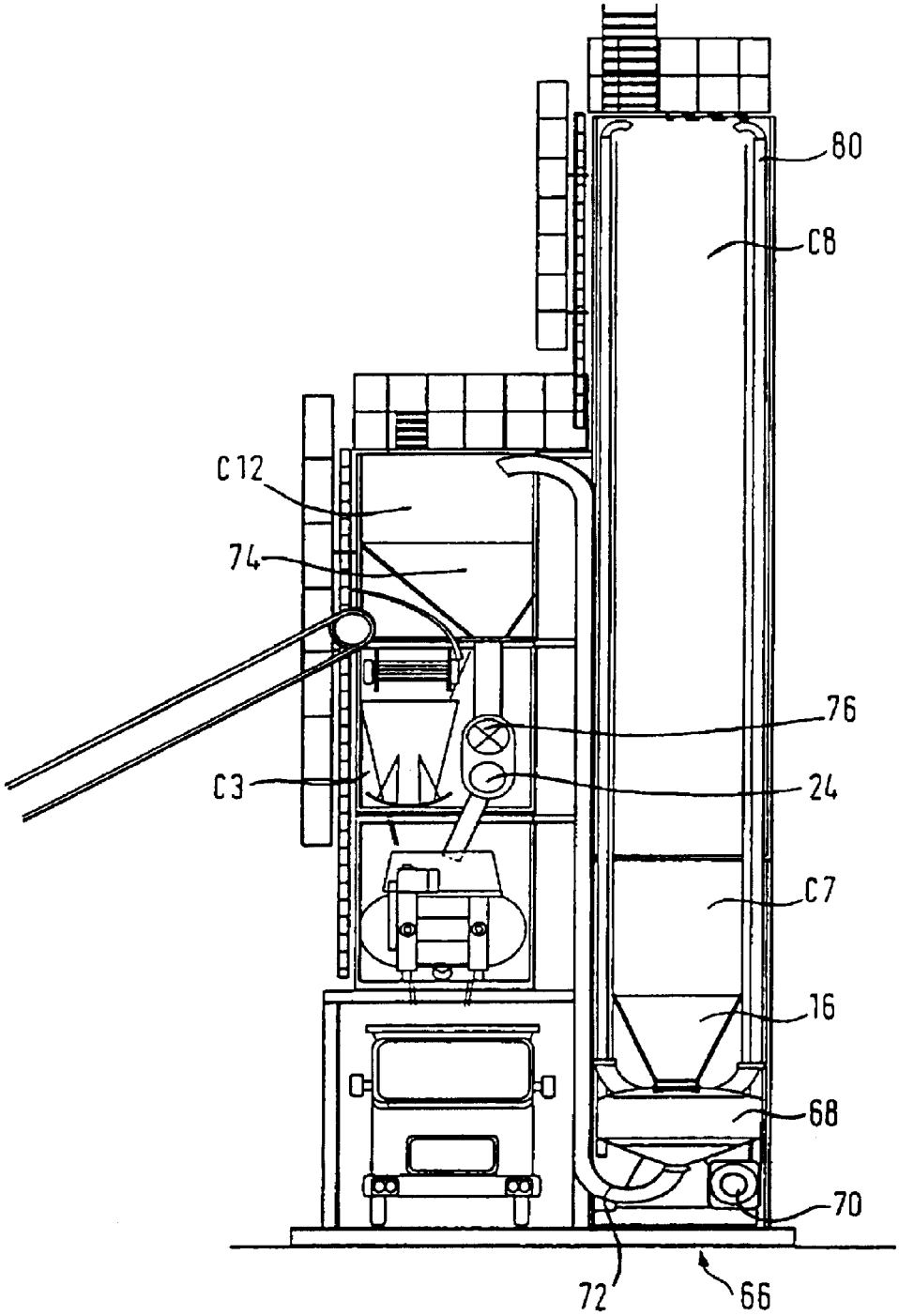
FIG. 14 shows a side view of a further embodiment of the transportable concrete mixing plant according to the invention with a compressed-air conveying device.
Figure 15:
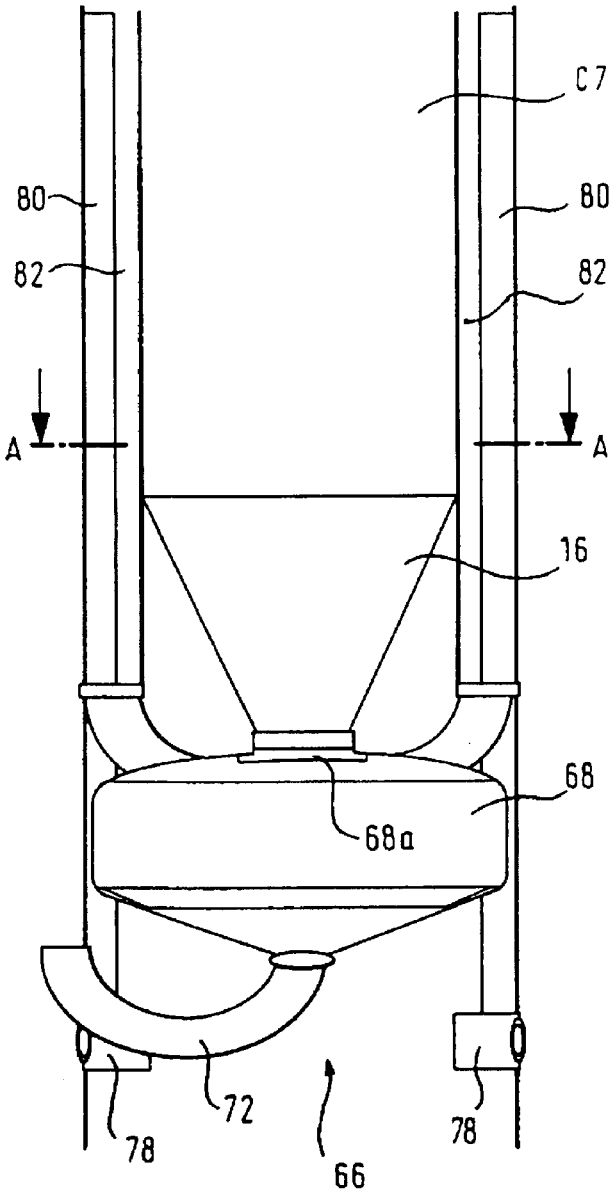
FIG. 15 shows an enlarged partial side view of the silo container of the embodiment of FIG. 14.
Figure 16:
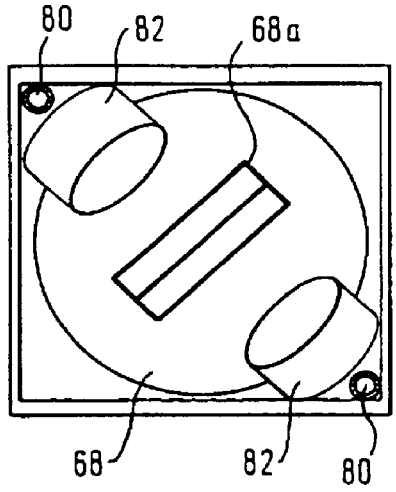
FIG. 16 shows a plan view of the silo container sectioned along the line A—A in FIG. 15.

FIGS. 14, 15 and 16 explain a further embodiment of the transportable concrete mixing plant 10 according to the invention. In this embodiment, instead of the feed screws 18, 20 and 22 provided in the previous embodiments, a pressure conveying device 66 is provided, in order to convey the materials contained in a silo container C7, C8, that is to say for example binders and/or additives, from this container C7, C8. For this purpose, a collecting vessel 68 is installed in the lower region of the lower silo container C7. In the upper wall of the collecting vessel 68, a motorized, pressure-tight closure flap 68*a* is provided in such a way that it is located precisely under the sower end of the hopper 16 fitted in the silo container C7.

The collecting vessel 68 as filled as follows: firstly, the silo containers C7, C8 are filled with binder or additive. In the embodiment illustrated in FIGS. 14 to 16, this is carried out by binder feed connecting elements 78 which are fitted in the lower region of the silo container C7 and can be opened to the outside, to which, in a manner known per se, there can be connected a connecting hose to a heavy goods vehicle equipped with a pressure conveying device and loaded with binder or additives. The materials conveyed by pressure from this heavy goods vehicle to the binder feed connecting elements 78 are forced into binder feed pipelines 80, which run approximately vertically upwards in the corners of the silo containers C7, C8 in FIGS. 14 to 16 and, in the upper region of the silo container C8 at the top, are curved towards the interior of the silo container C8, so that the materials forced under pressure via the binder feed connecting elements 78 into the binder feed pipeline 80 fall, at the upper end of these binder feed pipelines 80, into the inner region of the silo containers C7, C8. In the embodiment shown in FIGS. 14 to 16 of the transportable concrete mixing plant 10 according to the invention, in each case two such binder feed pipelines 80 are provided in the silo containers C7, C8 shown. This technique for filling binder silos is known per se and will not be explained specifically here.

The materials conveyed in this way into the silo containers C7, C8 fill the hopper 16 and those regions of the silo containers C7, C8 located above, and rest with a specific pressure on the pressure-tight closure flap 68*a* of the collecting vessel 68. When the closure flap 68*a* is opened by the motor, a specific quantity, determined by the opening duration, of the binder or additive falls into the collecting vessel 68, which is closed off again at the top in a pressure-tight manner by the subsequent closure of the closure flap 68*a*. The air to be expelled from the collecting vessel 68 as the binder or additive fills the latter can escape via air discharge lines 82, which run upwards from the upper edge region of the collecting vessel 68, essentially parallel to the binder feed pipelines 80, and open into a chimney provided with a filter at the upper end of the upper silo container C8. In the embodiment shown in FIGS. 14 to 16 of the transportable concrete mixing plant 10 according to the invention, the air discharge lines 82, for reasons of simplicity, have been depicted as recesses which are separated in a pressure-tight manner from the inner region of the silo containers C7, C8, and in which the binder feed pipelines 80 also run. Of course, however, the air discharge lines 82 can also be designed as pipelines.

The binder or additive put into the collecting vessel 68 in this way is then forced, with the aid of a compressor 70 connected to the collecting vessel 68, into a delivery hose 72 connected to the collecting vessel 68. In the embodiment illustrated in FIGS. 14 to 16, this delivery hose 72 runs upwards approximately vertically on the outer wall of the silo containers C7, C8, in a manner similar to the vertical feed screw 20 in the preceding embodiments, and opens into an intermediate binder container C12, which is erected on a stackable mixer container C3. The binder or additive delivered through the delivery hose 72 into the intermediate binder container C12 falls into a hopper 74 installed in the lower region of the intermediate binder container C12, this hopper opening via a corresponding hatch in the bottom of the intermediate binder container C12 via a rotary feeder 76, which is arranged above a binder compartment 24 in a stackable mixer container C3. The rotary feeder 76 not only ensures the decoupling of the pressures between !he binder or additive conveyed with pressure into the intermediate binder container C12 and the binder or additive to be weighed in the binder compartment 24, but, as a result of adjustment of its running speed, additionally permits pre-metering of the binder or additive to be metered precisely in the binder compartment 24.

As can be seen clearly in FIG. 14, an this embodiment the rotary feeder 76 and the binder compartment 24 are designed in one piece. It is of course also possible to arrange a rotary feeder 76 above a binder compartment 24 and separately from the latter.

Of course, it is not absolutely necessary for the delivery hose 72 to run upwards approximately vertically on the outer wall of the silo containers C7, C8 in the manner shown in FIG. 14. Instead, the use of a delivery hose 72 of this type offers the specific advantage of delivering binder or additive in a flexible way from silo containers C7, C8 to an intermediate binder container C12, which may be further removed, on a stackable mixer container C3.

Figure 17:
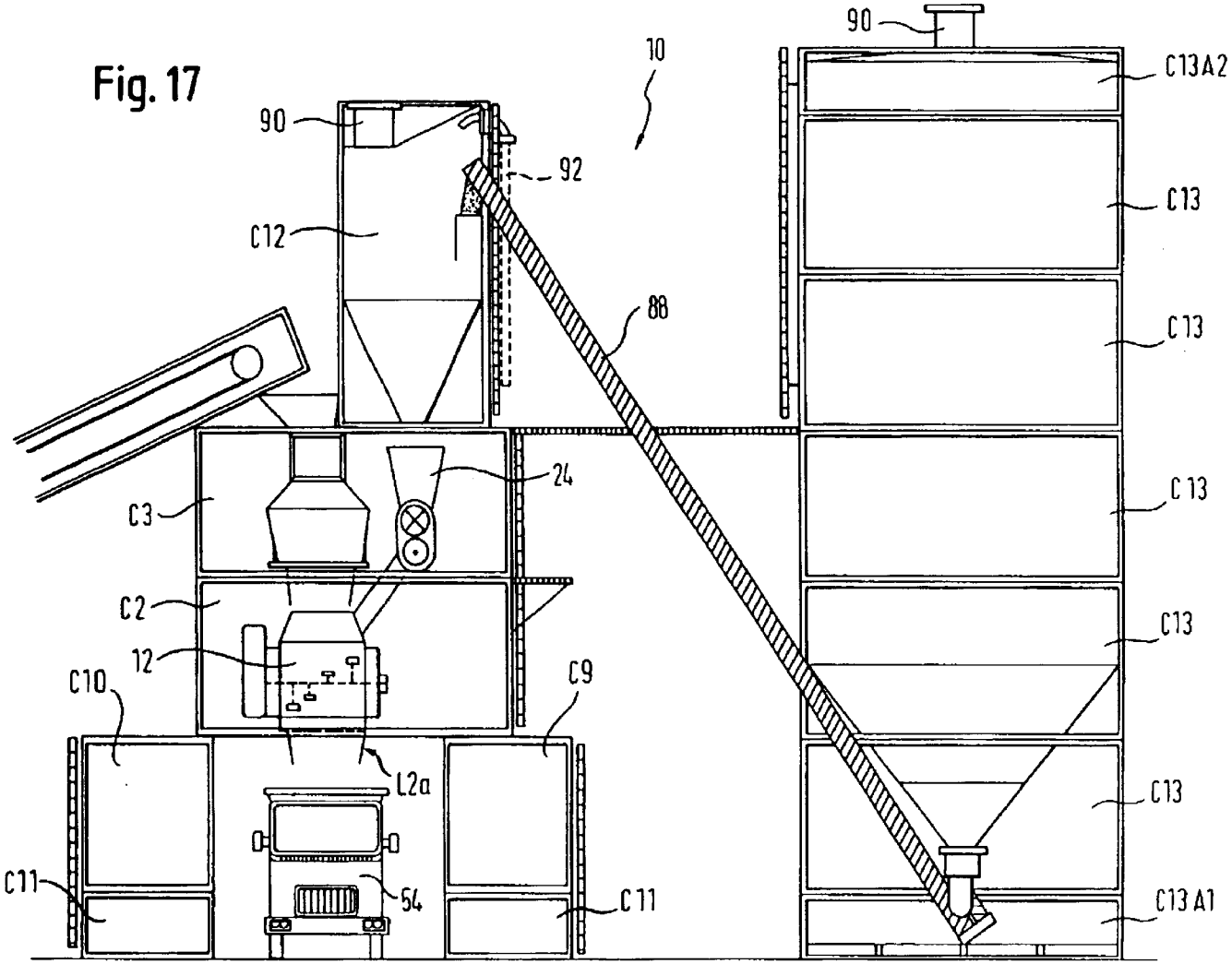
FIG. 17 shows a side view of a further embodiment of the transportable concrete mixing plant according to the invention with an intermediate binder container and a feed-screw arrangement.
Figure 18:
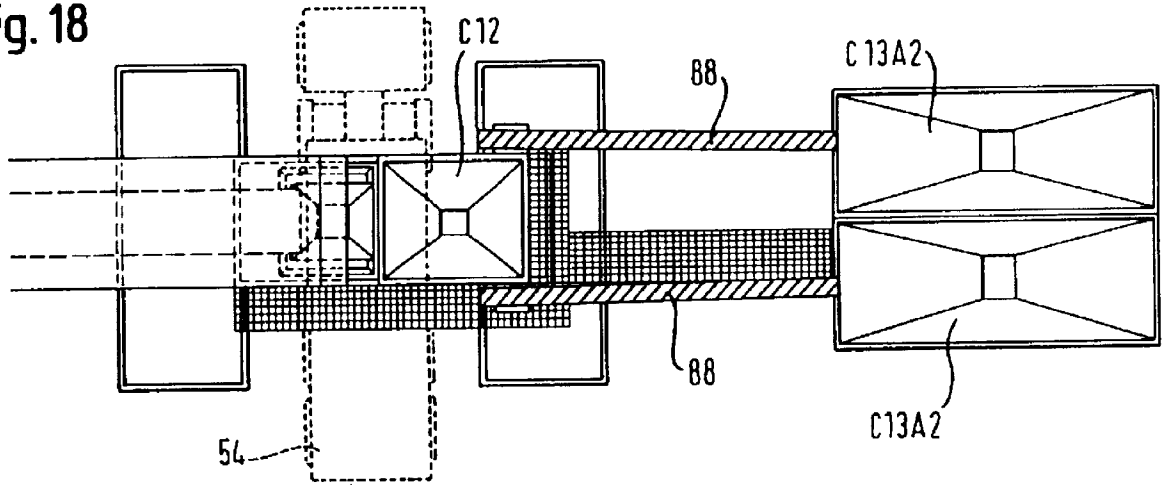
FIG. 18 shows a plan view of the concrete mixing plant of FIG. 17 when a mixer is used.
Figure 19:
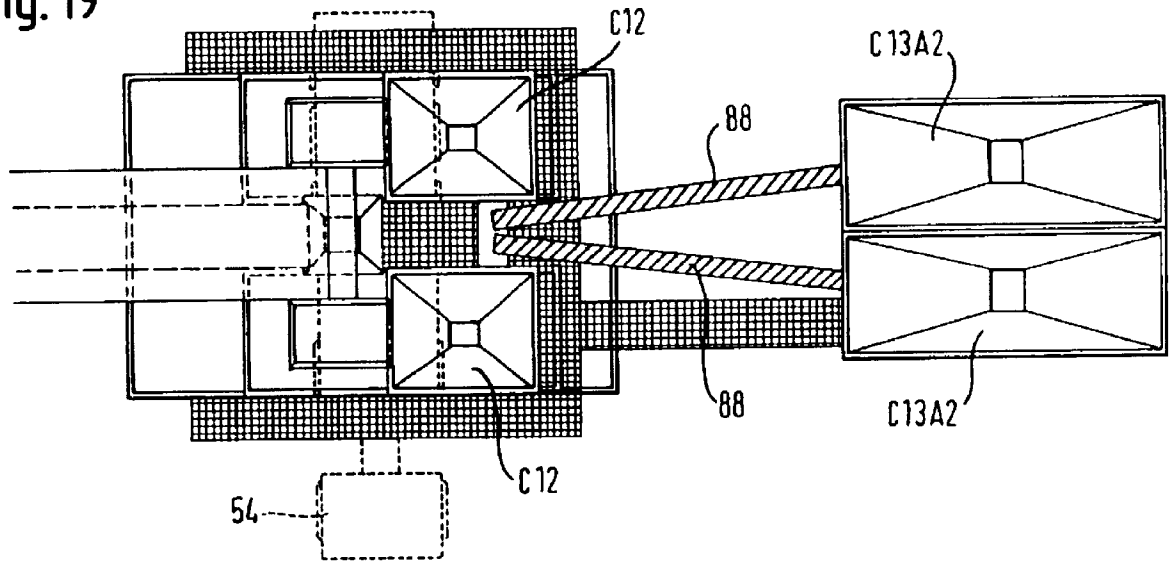
FIG. 19 shows a plan view of the concrete mixing plant of FIG. 17 when two mixers are used.

FIGS. 17, 18 and 19 explain a further embodiment of the transportable concrete mixing plant 10 according to the invention. In this embodiment, binder silo containers C13 are used, and are stacked on one another and parallel to one another with an essentially horizontal orientation. In FIG. 17, on the right, five such silo containers C13 are illustrated with their horizontal longitudinal axis lying in the plane of the drawing. The bottom and top surfaces of these silo containers C13 have been removed, following transport and during the construction of the transportable concrete mixing plant 10 according to the invention, so that, in the region of the transition between two silo containers C13, virtually no niches, corners or the like occur in which binders could accumulate in an undesired way. These five silo containers C13 have been erected on a lowest silo container C13A1 and are closed at the top by an uppermost silo container C13A2. As can be seen in FIG. 17, the lowest silo container C13A1 and the uppermost silo container C13A2 are only half as high as the five other silo containers C13. These two containers C13A1, C13A2 are specifically halves of a final silo container C13A which can be divided and which, when the concrete mixing plant 10 according to the invention is being transported, is also carried along as a closed container and, during the construction of the concrete mixing plant 10, is divided into the two halves illustrated. During transport, this final silo container C13A can accommodate components which are needed on the silo when the plant 10 is operating, for example the filter 90 illustrated on the uppermost container C13A2 at the top in FIG. 17, which filters binders out of the air expelled during the filling of the silo.

In a manner similar to that in the embodiments of the concrete mixing plant 10 according to the invention explained with reference to FIGS. 1–11, in the variant illustrated in FIGS. 17–19, binder is also conveyed out of the lower region of a binder silo, which is formed here by the five silo containers C13, the lowest silo container C13A1 and the uppermost silo container C13A2, by means of a feed-screw arrangement. However, in the embodiment of FIGS. 17–19, this conveyance is not carried out directly to a binder compartment 24 arranged in a stackable mixer container C3 but, similarly to the embodiment shown in FIG. 14, into an intermediate binder container C12, which is erected on a stackable mixer container C3. This conveyance of binder is carried out with the aid of an inclined binder feed screw 88 which, as can be seen in FIG. 17, runs directly from the lowest silo container C13A1 to the intermediate binder container C12. Because of this oblique run, the oblique binder feed screw 88 can be designed to be shorter than the sum of the lengths of the three feed screws 18, 20, 22 (shown, for example, in FIG. 1), each of which runs horizontally or vertically, which leads to savings in costs and facilitates assembly, since the operation of aligning a number of feed screws with one another is dispensed with.

As can be seen in the plan view of FIG. 19 (plant with one mixer) and of FIG. 19 (plant with two mixers), in this embodiment, in each case two "towers" of silo containers C13 arranged beside each other are provided, and are stacked parallel to each other with a horizontal orientation. In each case binder is conveyed out of the lowest silo container C13A1 of each tower by means of an inclined binder feed screw 88. In the variant shown in FIG. 18 of this embodiment, in which one mixer is used, the two inclined binder feed screws 88 do not lead directly into the intermediate binder container C12, but rather to chutes which are provided on the sides of the said container, in its upper region, and via which the binder delivered by the inclined binder feed screws 88 slides into the intermediate binder container C12. In a similar way, in the variant with two mixers shown in FIG. 19, the two inclined binder feed screws 88 each open at a corresponding chute, which leads to two intermediate binder containers C12, each of which is arranged above a binder compartment 24 for supplying one mixer 12.

The intermediate binder container C12 is also equipped with a binder feed line 92, drawn dashed in FIG. 17, which, similarly to the silo containers C7, C8 explained in FIGS. 14–16, makes it possible to fill the intermediate binder container C12 from a heavy goods vehicle or the like delivering binder, for example with the aid of a pressure conveying device described above. Since the intermediate binder container C12 can therefore be filled in two different ways, namely on the one hand from the silo containers C13 via the inclined binder feed screw 88 and, on the other hand, from a delivery vehicle via the binder feed line 92, the continuous supply of the mixer 12 with binder can be ensured with great certainty.

In the embodiment illustrated in FIGS. 17–19, two further containers are arranged on a mixer container C2, namely a stackable mixer container C3 and, on the latter, in turn an intermediate binder container C12. The total weight resulting from this generally rules out erecting the mixer container C2 on a mixer frame 52, such as is shown, for example, in FIG. 1. In order nevertheless co offer the possible capability of being able to let concrete directly out of the mixer container C2 into a heavy goods vehicle 54 or the like provided under the mixer container C2, in the embodiment shown in FIGS. 17–19, the mixer container is C2 is in each case erected at its ends on other containers, so that a lower middle region of the mixer container C2, in which there is at least one openable hatch L2*a* for the removal of concrete, is freely accessible. In FIG. 17, the mixer container C2 has been erected at its left-hand end on a control-station container C10, which in turn stands on a water container C11. That end of the mixer container C2 which is on the right in FIG. 17 is erected on an additive container C9, which in turn likewise stands on a water container C11. In this arrangement, a heavy goods vehicle 54 which is provided is able to drive under the openable hatches L2*a* of the mixer container C2 and accept concrete which is let out. The water containers C11, shown for the erection of the mixer container C2 in FIG. 17, are each half an high as the additive container C9 and the control-station container C10. It goes without saying that water containers C11 or other containers of the transportable concrete mixing plant 10 according to the invention can also be used if they have the same height as the containers C9, C10, so that in this case the mixer container C2 would stand higher. The important factor regarding the selection of the containers which are used to support the mixer container C2 at its left-hand and right-hand ends is that the mixer container C2 stands sufficiently high to ensure that the heavy goods vehicle 54 car drive in without difficulty, but does not stand so high that concrete let out could fall alongside the heavy goods vehicle 54 or could fail onto the loading surface of the latter at too high a speed.

It goes without saying that this manner of erecting the mixer container C2 can in principle be selected as an alternative to using a mixer frame 52 or an offloading container C1, irrespective of the embodiment of FIGS. 17–19.

Figure 20:
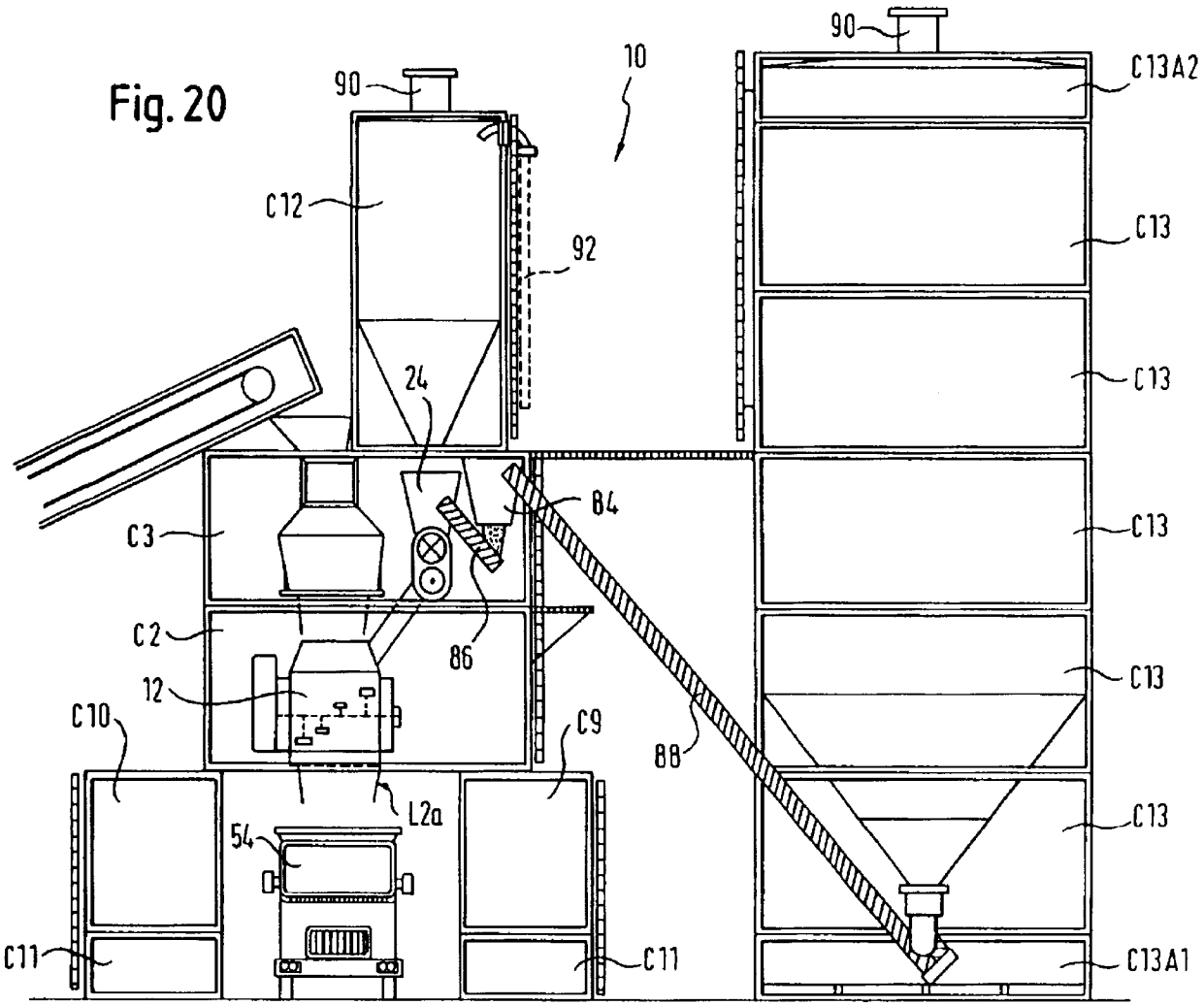
FIG. 20 shows a side view of a further embodiment of the transportable concrete mixing plant according to the invention with an intermediate binder vessel in a stackable mixer container.
Figure 21:
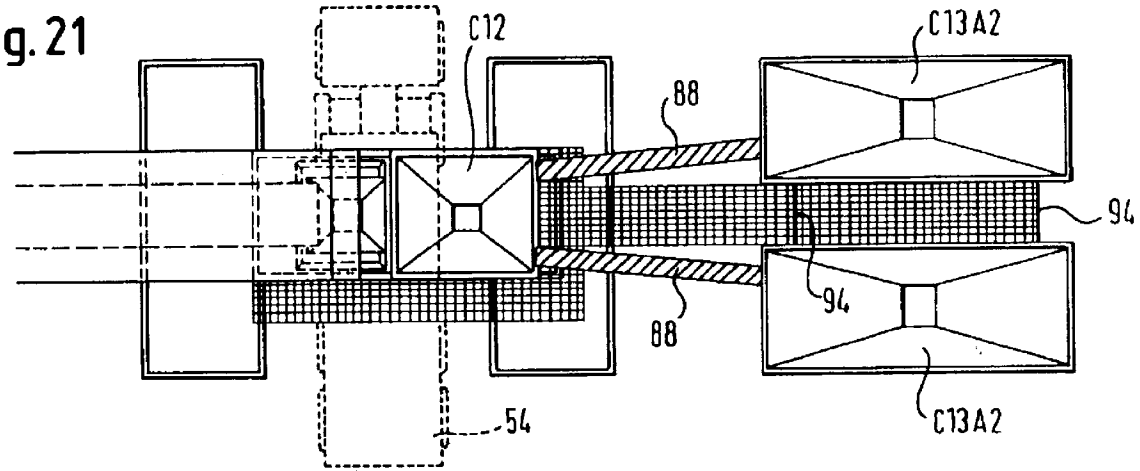
FIG. 21 shows a plan view of the concrete mixing plant of FIG. 20 when one mixer is used.
Figure 22:
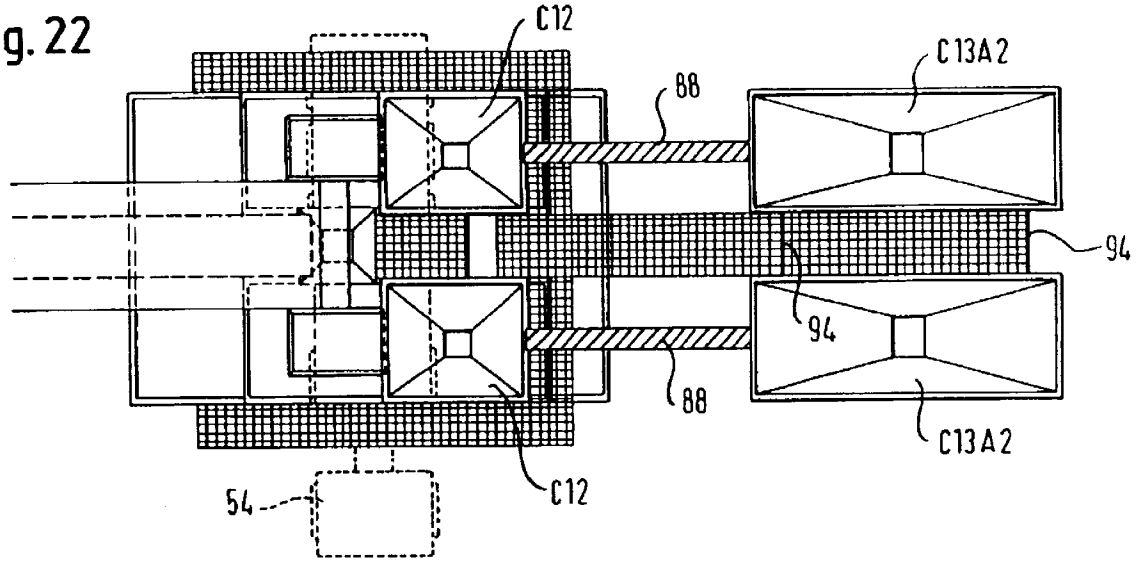
FIG. 22 shows a plan view of the concrete mixing plant of FIG. 20 when two mixers are used.

The embodiment shown in FIGS. 20–22 of the transportable concrete mixing plant 10 according to the invention is similar to that illustrated in FIGS. 17–19. In the following text, therefore, only the differences from the embodiment described above will be explained.

In the embodiment shown in FIGS. 20–22 of the transportable concrete mixing plant 10 according to the invention, an intermediate binder container C12 is also erected on a stackable mixer container C3, above the binder compartment 24 provided in the latter. However, in this embodiment, the oblique binder feed screw 88 does not deliver binder from the silo containers C13 into the intermediate binder container C12, but into an intermediate binder vessel 84, which is provided in the stackable mixer container C3, at the top right in FIG. 20. From this intermediate binder vessel 84, binder is in turn conveyed by means of a feed screw 86 into the binder compartment 24. It goes without saying that, depending on the size and relative arrangement of the binder compartment 24 and the intermediate binder vessel 84, a simple chute or slide or a small pressure conveying device can also be provided instead of a feed screw 86.

The course, selected in this embodiment, of the oblique binder feed screw 88 from the lowest silo container C13A1 to the intermediate binder vessel 84 in the stackable mixer container C3 permits the use of a shorter oblique binder feed screw 88, by comparison with the embodiment explained using FIGS. 17–20, which can contribute to cost savings and can make transport and assembly easier.

In this embodiment, the intermediate binder container C12 is likewise equipped with a binder feed line 92 and can therefore, as already explained above, be filled from a heavy goods vehicle or the like delivering binder.

As the plan views in FIG. 21 (one mixer) and in FIG. 22 (two mixers) show, in the embodiment being considered here, by contrast with the embodiment explained using FIGS. 17–19, the two "towers" of silo containers C13, which are stacked in parallel on one another with an essentially horizontal longitudinal axis, are erected separately from one another and connected to one another by transverse struts 94. This permits greater stability of the silo containers C13 against falling over to be achieved, which is particularly significant if the transportable concrete mixing plant 10 according to the invention is used or building sites which are exposed to severe winds.

The invention is not restricted to the embodiments cited by way of examples. Thus, from the three embodiments described above, it can be seen that the transportable concrete mixing plant 10 according to the invention can in principle have any desired number of mixers 12. In addition, it is possible to supply a number of mixers with binder by means of a single binder silo, it being possible to use a conveyor belt for binders similar to the aggregate conveyor belt 56 presented in the third embodiment, capable of being displaced between various operating positions and having a running direction which can optionally be changed over. Furthermore, the number of metering-unit containers C5 used, with associated stackable metering containers C6, can also optionally be varied with respect to the embodiments presented, depending on the number of mixers 12 used and the speed with which they produce concrete. It is likewise possible, in order to feed aggregates to the pilot silos 48, to use more than one inclined conveyor belt 44. Furthermore, the relative arrangement of the containers can of course be modified with respect to the embodiments presented, while fully maintaining the functioning of the transportable concrete mixing plant 10 according to the invention and without leaving the scope of the invention.

What is claimed is:

1. A transportable concrete mixing plant (10) comprising a plurality of mixing plant components detachably connectable with each other; and a plurality of containers (C1, C2, C3, C4, C5, C6, C7, C8, C9, C10, C11, C12, C13) for accommodating the mixing plant components during transportation, at least some of the containers (C1–C13) serving as load bearing structures for at least some of the mixing plant components and containers for concrete raw materials in an operational condition of the plant (10), wherein the plurality of mixing plant components includes a plurality of mixers (12) provided in at least one mixer container (C2) for mixing of aggregates;

wherein each mixer (12) is assigned a pilot silo (48) for storing binder and a binder hopper (24) for receiving at least one of the binders and aggregates from at least one silo container (C7, C8);

wherein the plurality of containers includes a plurality of metering-unit containers (C5) containing additives; and wherein the mixing plant components include conveying means (42, 44, 46) for delivering additives from various metering-unit containers (C5) to respective mixers (12).

2. A transportable concrete mixing plant (10) according to claim 1, wherein the containers (C1, C3, C4, C5, C6, C7, C8, C9, C10, C11, C12, C13) are formed as standard shipping containers for being transported in a standard way in accordance with international regulations by ship, rail and heavy goods vehicles.

3. A transportable concrete mixing plant (10) according to claim 1, wherein the containers (C1, C3, C4, C5, C6, C7, C8, C9, C10, C11, C12, C13) are adapted to be combined into standard shipping containers for being transported in a standard way in accordance with international regulations by ship, rail and heavy goods vehicles.

4. A transportable concrete mixing plant (10) according to claim 1, wherein at least some containers (C1, C3, C4, C5, C6, C7, C8, C9, C10, C11, C12, C13) have openable hatches (L1, L1*a*, L2, L2*a*, L3, L3*a*, L3*b*, L4, L4*a*, L5, L5*a*, L6, L7) for enabling the mixing plant components accommodated in various containers (C1, C3, C4, C5, C6, C7, C8, C9, C10, C11, C12, C13) to work together in the operational condition of the mixing plant (10).

5. A transportable concrete mixing plant (10) according to claim 4, wherein in the operating condition of the mixing plant (10) the mixer container (C2) is set up on its ends on at least one other container (C1, C2, C3, C4, C5, C6, C7, C8, C9, C10, C11, C12, C13) in such a way that concrete can be let out through the openable hatches (L2*a*) for removing concrete from the mixer container (C2) into a heavy goods vehicle (54) provided under the mixer container (C2).

6. A transportable concrete mixing plant (10) according to claim 1, wherein a wall of the at least one mixer container (C2), which is located above each mixer (12) in the operating condition of the mixing plant (10), has an openable hatch (L2).

7. A transportable concrete mixing plant (10) according to claim 6, wherein the plurality of containers comprises at least one stackable mixer container (C3) mountable on the at least one mixer container (C2) and which contains loading means for introduction of at least one of the binders, aggregates, and additives into each mixer (12) through the openable hatches (L2) located above the mixers (12) and through openable hatches (L3) located in a bottom wall of the stackable mixer container (C3) opposite the hatches (L2) provided in the wall located above each mixer (12).

8. A transportable concrete mixing plant (10) according to claim 7, comprising binder conveying means (22) extendable through an openable hatch (L3*a*) provided in a wall of the stackable container (3) for delivering of at least one of binder and additive into the stackable mixer container (C3).

9. A transportable concrete mixing plant (10) according to claim 8, wherein the binder conveying means (22) is formed as a feed screw.

10. A transportable concrete mixing plant (10) according to claim 7, wherein the plurality of mixers comprises at least two mixers (12), and wherein the mixing plant components comprise aggregate conveying means (56) having a change-over running direction for feeding the aggregates to the respective loading means associated with respective ones of the at least two mixers.

11. A transportable concrete mixing plant (10) according to claim 10, wherein the aggregate conveying means (56) is formed as a conveyor belt.

12. A transportable concrete mixing plant (10) according to claim 7, wherein the plurality of mixers comprises at least three mixers (12), wherein the aggregate conveying means (56) are movable to and fro over the loading means between a number of operating positions in which each end of the aggregate conveying means (56) is associated with respective loading means associated with respective ones of the at least three mixers.

13. A transportable concrete mixing plant (10) according to claim 7, wherein the conveying means (42, 44, 46) includes an inclined conveying means (44) passing through at least one wall of the stackable mixer container (C3) through an openable hatch (L3*b*) for introducing aggregates into the stackable mixer container (C3).

14. A transportable concrete mixing plant (10) according to claim 13, wherein the inclined conveying means (44) is formed as a conveyor belt which, during transportation, is accommodated in a folded-up state in an inclined conveyor-belt container (C4).

15. A transportable concrete mixing plant (10) according to claim 7 wherein a bottom, in the operating condition of the mixing plant (10), wall of the at least one mixer container (C2) has, under each mixer (12), a hatch (L2*a*) which can be opened to remove concrete from the mixer container (C2).

16. A transportable concrete mixing plant (10) according to claim 15, wherein the mixer container (C2) is erectable on a standing surface of a mixer frame (52) which is dimensioned such that concrete can be discharged through the openable hatches (L2*a*).

17. A transportable concrete mixing plant (10) according to claim 15, wherein in the operating condition of the mixer plant, the at least one mixer container (C2) stands on an offloading container (C1) in a top wall of which openable hatches (L1) are provided, opposite the openable hatches (L2*a*) in the bottom wall of the mixer container (C2).

18. A transportable concrete mixing plant (10) according to claim 17, wherein there is provided, in one end wall of the offloading container (C1), an openable hatch (L1*a*) for passing a concrete conveying device for conveying concrete which, during transportation, is accommodated completely in the offloading container (C1).

19. A transportable concrete mixing plant (10) according to claim 18, wherein the concrete conveying device comprises an upper concrete collecting belt (60) which in the operating condition of the mixing plant, is accommodated completely in the offloading container (C1), and a lower concrete conveyor belt (62) which passes through the openable hatch (L1*a*) in the end wall of the offloading container (C1).

20. A transportable concrete mixing plant (10) according to claim 19, wherein each mixer (12) is assigned a silo container for concrete additive.

21. A transportable concrete mixing plant (10) according to claim 20, wherein each binder silo and additive silo container (C7, C8), respectively, stands upright on an end face thereof.

22. A transportable concrete mixing plant (10) according to claim 21, wherein there are provided at least two binder silo and additive silo containers (C7, C8) erected one of beside one another and on one another.

23. A transportable concrete mixing plant (10) according to claim 22, wherein at least two binder silo and additive silo containers (C7, C8) are fastened by transverse struts (28) to at least one of the stackable mixer container (C3), the mixer container (C2), the offloading container (C1), and the mixer frame (52) for purpose of stabilization.

24. A transportable concrete mixing plant (10) according to claim 22, wherein each silo container (C7) which is not standing on a further silo container (C7, C8) in the operating condition of the mixing plant (10), contains in a lower region thereof a hopper (16) an upper cross-section of which essentially corresponds to a cross-section of the silo container (C7) and which tapers downwards.

25. A transportable concrete mixing plant (10) according to claim 24, wherein in the operating condition of the mixing plant (10), one of binder and additive conveying means (18) is arranged underneath an opening of the hopper (16) and passes through a side wall of the silo container (C7) through an opened hatch (L7).

26. A transportable concrete mixing plant (10) according to claim 25, wherein one of the binder and additive conveying means (18) is formed as a feed screw.

27. A transportable concrete mixing plant (10) according to claim 25, wherein one of the binder and additive conveying means (18) cooperates with a vertical conveying means (20) which runs essentially one of vertically and obliquely upwards on an outer wall of the silo container (C7) in such a way that it can transfer one of binder and additive to the silo container (C7) for an onward conveyance.

28. A transportable concrete mixing plant (10) according to claim 27, wherein one of the vertically and obliquely running conveying means (20) is formed as a feed screw.

29. A transportable concrete mixing plant (10) according to claim 27, wherein the one of the vertically and obliquely running conveying means (20) cooperates with one of the binder and additive conveying means (22), which runs partly in the at least one stackable mixer container (C3) in such a way that it transfers one of binder and additive to the stackable mixer container (C3) for an onward conveyance.

30. A transportable concrete mixing plant (10) according to claim 22, wherein each silo container (C7) which is not standing on a further silo container (C7, C8), has on an end face thereof, which is located at a bottom in the operating condition of the mixing plant (10), a concrete slab (26) for stabilization.

31. A transportable concrete mixing plant (10) according to claim 20, wherein each silo container (C7) which is not standing on a further silo container (C7, C8), the offloading container (C1), and the mixer frame A(52), is fastened to a common baseplate (14).

32. A transportable concrete mixing plant (10) according to claim 20, wherein ladders (30) and safety railings (32) are provided on an outside of the silo containers (C7, C8) which, during transportation, are accommodated in the silo container (C7, C8).

33. A transportable concrete mixing plant (10) according to claim 20, wherein at least one of a concrete finisher (64) and a working platform are accommodated, during transportation, in the silo container (C7, C8).

34. A transportable concrete mixing plant (10) according to claim 7, wherein the plurality of containers includes at least one intermediate binder container (C12) for intermediate storage of binder, which is erected on the at least one stackable mixer container (C3).

35. A transportable concrete mixing plant (10) according to claim 34, wherein a delivery hose (72) opens into the at least one intermediate binder container (C12).

36. A transportable concrete mixing plant (10) according to claim 34, wherein the at least one intermediate binder container (C12) contains a hopper (74), which opens into a rotary feeder (76) which is arranged above the binder hopper (24) in the stackable mixer container (C3).

37. A transportable concrete mixing plant (10) according to claim 7, comprising at least one intermediate binder vessel (84) for the intermediate storage of binder and arranged in the at least one stackable mixer container (C3).

38. A transportable concrete mixing plant (10) according to claim 37, comprising binder delivery means (86) arranged in the at least one stackable mixer container (C3) for delivering binder form the at least one intermediate binder vessel (84) into the binder hopper (24).

39. A transportable concrete mixing plant (10) according to claim 1, wherein the binder hopper (24) contains a balance.

40. A transportable concrete mixing plaint (10) according to claim 1, wherein each metering-unit container (C5) contains a metering device (34) for metering the additives.

41. A transportable concrete mixing plant (10) according to claim 40, wherein the metering device (34) has at least one weighting conveyor belt (34*a*) for weighing and transporting the additives, and at least one loading means (34*b*) associated with the weighing conveyor belt (34*a*).

42. A transportable concrete mixing plant (10) according to claim 41, wherein each loading means (34*b*) is formed by a hopper which is arranged above the weighting conveyor belt (34), which tapers downwards, and upwards, opens wide towards an openable hatch (L5) in a side wall of the metering unit container (C5).

43. A transportable concrete mixing plant (10) according to claim 42, wherein each metering-unit container (C5) cooperates with a stackable metering container (C6) of essentially a same length, whose halves, when operating, are placed beside each other and parallel to the metering-unit container (C5) oriented with respect to the stackable metering container (C6), and which, with aid of a baffle-plate device and openable hatches (L5, L6) in an upper wall of the metering-unit container (C5) and in the lower side wall of each half of the stackable metering container (C6), enlarge an effective upper filling cross-section of each hopper (34*b*) in the metering-unit container (C5).

44. A transportable concrete mixing plant (10) according to claim 43, wherein the baffle-plate device comprises baffle plates (36) which are permanently arranged in the stackable metering container (C6) and run obliquely and which, in the operating condition of the mixing plant (10), lengthen walls of each hopper (34*b*) in the metering-unit container (C5) upwards into the halves of the stackable metering container (C6).

45. A transportable concrete mixing plant (10) according to claim 44, wherein the baffle-plate device further comprises further baffle plates (38) which are rotatably mounted essentially at corners of the halves of the of the stackable metering container (C6) and, in the operating condition of the mixing plant (10), are folded out of the stackable metering container (C6) in such a way that they enlarge the opening of the hopper (34*b*) at the top.

46. A transportable concrete mixing plant (10) according to claim 41, wherein the conveying means (42) runs underneath the at least one weighting conveyor belt (34*a*), parallel thereto, and is displaced in a longitudinal direction, partly out of the metering-unit container (C5), through an openable hatch (L5*a*) in an end face of the metering-unit container (C5).

47. A transportable concrete mixing plant (10) according to claim 46, wherein the conveying means (42) is formed as a conveyor belt.

48. A transportable concrete mixing plant (10) according to claim 46, wherein an end of the feed conveying means (42) which, in the operating condition of the mixing plant (10), is located outside the metering-unit container (C5), is arranged above the inclined conveying means (44) for feeding aggregates to the stackable mixer container (C3).

49. A transportable concrete mixing plant (10) according to claim 1, wherein the plurality of containers comprises an additive container (C9) to accommodate concrete additives.

50. A transportable concrete mixing plaint (10) according to claim 1, wherein the plurality of containers comprises a control-station container (C10), in which a control station for controlling the components of the concrete mixing plant (10) is accommodated.

51. A transportable concrete mixing plant (10) according to claim 1, wherein the plurality of containers comprises a water container (C11).

52. A transportable concrete mixing plant (10) according to claim 1, comprising covering, insulation, partitioning, warming, and heating means for individual mixing plaint components, including the at least one mixer container (C2), a stackable mixer container (C3), conveyor belts (34*a*, 44, 56, 62), the metering-unit containers (C5), additive container (C9) and water container (C11), whereby a mixing operation becomes possible even at an ambient temperatures below 0° C.

53. A transportable concrete mixing plaint (10) according to claim 1, wherein the mixing plant components include a compressed-air conveying device (66), for conveying by pressure from at least one silo container (C7).

54. A transportable concrete mixing plant (10) according to claim 53, wherein the pressure conveying device (66) comprises a collecting vessel (68) with a compressor (70) and a delivery hose (72) connected to the collecting vessel (68).

55. A transportable concrete mixing plant (10) according to claim 54, wherein the collecting vessel (68) and the compressor (70) are arranged in a lower region of the silo container (C7).

56. A transportable concrete mixing plant (10) according to claim 1, wherein the plurality of containers includes at least one of binder silo containers and additive silo containers (C13) which, in the operating condition of the mixing plant (10), are stacked on one another and parallel to one another with essentially horizontal orientation.

57. A transportable concrete mixing plant (10) according to claim 56, wherein the plurality of containers includes a final silo container (C13A) which can essentially be divided into two halves (C13A1, C13A2) which, in the operating condition of the mixing plant (10), form lowest (C13A1) and uppermost (C13A2) containers of a group of silo containers (C13) stacked on one another and parallel to one another.

58. A transportable concrete mixing plant (10) according to claim 56, wherein the at least one of binder silo containers and the additive silo containers (C13) each have removable bottom and top surfaces.

* * * * *